US010426677B2

(12) United States Patent
Ferniany et al.

(10) Patent No.: US 10,426,677 B2
(45) Date of Patent: Oct. 1, 2019

(54) RECLINING TRANSPORT CHAIRS

(71) Applicant: Movi Medical, LLC, Birmingham, AL (US)

(72) Inventors: William Ferniany, Birmingham, AL (US); Lloyd Cooper, Birmingham, AL (US)

(73) Assignees: The UAB Research Foundation, Birmingham, AL (US); MOVI Medical, LLC, Birmingham, AL (US)

( * ) Notice: Subject to any disclaimer, the term of this patent is extended or adjusted under 35 U.S.C. 154(b) by 46 days.

(21) Appl. No.: 15/452,454

(22) Filed: Mar. 7, 2017

(65) Prior Publication Data

US 2017/0172825 A1 Jun. 22, 2017

Related U.S. Application Data

(63) Continuation-in-part of application No. 15/173,259, filed on Jun. 3, 2016, which is a continuation of application No. 13/574,267, filed as application No. PCT/US2011/021834 on Jan. 20, 2011, now Pat. No. 9,358,166.

(60) Provisional application No. 61/296,724, filed on Jan. 20, 2010, provisional application No. 61/304,638, filed on Feb. 15, 2010, provisional application No. 61/304,699, filed on Feb. 15, 2010.

(51) Int. Cl.

| | |
|---|---|
| ***A61G 5/12*** | (2006.01) |
| ***A61G 5/10*** | (2006.01) |
| *A61G 5/14* | (2006.01) |

(52) U.S. Cl.

CPC ..... *A61G 5/121* (2016.11); *A61G 5/1027* (2013.01); *A61G 5/1037* (2013.01); *A61G 5/1075* (2013.01); *A61G 5/1094* (2016.11); *A61G 5/125* (2016.11); *A61G 5/128* (2016.11); *A61G 5/14* (2013.01); *A61G 2203/76* (2013.01)

(58) Field of Classification Search

CPC .... A61G 5/121; A61G 5/1094; A61G 5/1037; A61G 5/1027; A61G 5/128; A61G 5/125; A61G 5/1075; A61G 5/14; A61G 2203/76

USPC ..... 280/250.1

See application file for complete search history.

(56) References Cited

U.S. PATENT DOCUMENTS

| | | | |
|---|---|---|---|
| 490,516 | A | 1/1893 | Starr |
| 1,469,928 | A | 2/1920 | Lazar |
| 2,053,852 | A | 9/1936 | Tracy |
| 3,379,450 | A | 4/1968 | Jones et al. |
| 3,787,089 | A | 1/1974 | Wrethander |
| 3,851,917 | A | 12/1974 | Horstmann et al. |

(Continued)

*Primary Examiner* — Joseph M Rocca
*Assistant Examiner* — Felicia L. Brittman
(74) *Attorney, Agent, or Firm* — Thomas G. Peterson; Maynard Cooper Gale

(57) ABSTRACT

A transport chair is provided that includes a base frame, a seat assembly pivotally mounted to the base, and a footrest assembly pivotally mounted to the base frame, the footrest assembly being associated with the seat assembly so as to pivot in unison with the seat assembly until the seat assembly is pivoted forward to an extent at which the footrest assembly contacts the floor or ground, at which point the footrest assembly does not pivot further upon further forward pivoting of the seat assembly. Further embodiments of the transport chair allow the seat assembly to recline, alone or in unison with a leg rest assembly, while the footrest remains in position.

20 Claims, 18 Drawing Sheets

(56) References Cited

U.S. PATENT DOCUMENTS

| | | | | |
|---|---|---|---|---|
| 3,964,786 | A * | 6/1976 | Mashuda | A61G 5/006 297/330 |
| 4,076,304 | A | 2/1978 | Deucher | |
| 4,506,930 | A | 3/1985 | Lambert | |
| 4,538,857 | A | 9/1985 | Engman | |
| 4,598,944 | A | 7/1986 | Meyer et al. | |
| 4,678,229 | A | 7/1987 | Ryan et al. | |
| 4,779,922 | A | 10/1988 | Cooper | |
| 4,861,059 | A | 8/1989 | Shirk | |
| 5,056,864 | A | 10/1991 | Cooper | |
| 5,094,508 | A | 3/1992 | Bathrick et al. | |
| 5,108,202 | A | 4/1992 | Smith | |
| 5,180,181 | A | 1/1993 | Letechipia | |
| 5,286,046 | A | 2/1994 | Bottemiller et al. | |
| 5,316,370 | A | 5/1994 | Newman | |
| 5,346,280 | A | 9/1994 | Deumite | |
| 5,354,079 | A | 10/1994 | Hettenbach | |
| 5,356,172 | A | 10/1994 | Levy et al. | |
| 5,375,913 | A | 12/1994 | Blanchard | |
| 5,421,598 | A | 6/1995 | Robertson et al. | |
| 5,479,666 | A | 1/1996 | Foster et al. | |
| 5,513,867 | A | 5/1996 | Bloswick et al. | |
| 5,707,104 | A | 1/1998 | Perego | |
| 5,865,457 | A * | 2/1999 | Knabusch | A61G 5/006 280/304.1 |
| 5,984,338 | A | 11/1999 | Meyer | |
| 6,000,758 | A | 12/1999 | Schaffner et al. | |
| 6,142,568 | A | 11/2000 | Abelbeck et al. | |
| 6,154,690 | A | 11/2000 | Coleman | |
| 6,154,899 | A | 12/2000 | Brooke et al. | |
| 6,161,848 | A | 12/2000 | Beumer et al. | |
| 6,192,533 | B1 | 2/2001 | Porcheron | |
| 6,250,717 | B1 | 6/2001 | Porcheron | |
| 6,315,306 | B1 | 11/2001 | Fernie et al. | |
| 6,386,614 | B1 | 5/2002 | Logan | |
| 6,412,795 | B1 | 7/2002 | Beumer et al. | |
| 6,425,634 | B1 | 7/2002 | Romero | |
| 6,431,650 | B1 | 8/2002 | Visone | |
| 6,684,427 | B2 | 2/2004 | Allen et al. | |
| 6,792,633 | B1 * | 9/2004 | Ito | A61G 5/006 5/618 |
| 6,793,232 | B1 | 9/2004 | Wing | |
| 6,851,751 | B1 | 2/2005 | Romero et al. | |
| 7,044,498 | B2 | 5/2006 | Chen | |
| 7,219,912 | B2 | 5/2007 | Meyer | |
| 7,234,776 | B2 | 6/2007 | Laffin | |
| 7,338,133 | B2 | 3/2008 | Laffin | |
| 2002/0005300 | A1 | 1/2002 | Saleem | |
| 2004/0205895 | A1 | 10/2004 | Ito | |

* cited by examiner

RECLINING TRANSPORT CHAIRS

CROSS-REFERENCE TO RELATED APPLICATION

This application is a continuation-in-part application of U.S. patent application Ser. No. 15/173,259, filed 3 Jun. 2016 (pending). U.S. patent application Ser. No. 15/173,259 is a continuing application of U.S. patent application Ser. No. 13/574,267, filed 2 Jul. 2012 (now U.S. Pat. No. 9,358,166). U.S. Pat. No. 9,358,166 is a national stage entry of International Pat. App. No. PCT/US11/21834, filed 20 Jan. 2011 (abandoned). International Pat. App. No. PCT/US11/21834 cites the priority of provisional U.S. Pat. App. Nos. 61/304,638 filed 15 Feb. 2010 (expired); 61/304,699 filed 15 Feb. 2010 (expired); and 61/296,724, filed 20 Jan. 2010 (expired). The contents of all of the foregoing patent applications are incorporated by reference in their entireties herein.

BACKGROUND

It is common to transport hospital patients in wheelchairs. In such situations, the patient normally sits in the wheelchair and an operator, often referred to as the escort, pushes the wheelchair to move the patient to the desired location. To accomplish this, the escort often must maneuver the chair and patient in and out of elevators, through hallways, up and down ramps, into and out of rooms, etc. In addition, the escort often must assist the patient out of the chair or into the chair. Unfortunately, conventional wheelchairs are not very effective in such circumstances because they are designed for self-mobility, not patient transport.

One drawback of conventional wheelchairs is that escorts must bend over to reach the handles of the wheelchair to push it. The handles normally extend straight back toward the escort in an orientation that is unnatural for the escort and the handles are typically not adjustable. In addition, wheelchairs do not provide enough room for the escort's feet when walking, especially when longer strides are taken as when the escort is tall or when the escort is moving quickly. Furthermore, wheelchairs do not provide adequate storage for items such as the patient's belongings or medical documents and equipment. Typically, the only storage that is provided is a rear pocket that is integrated into the flexible seatback of the wheelchair. When items are placed in the pocket, the items tend to poke the patient in the back thereby making for an uncomfortable ride. Moreover, the upright sitting position and absence of head support can be uncomfortable for the patient over longer periods of time, even when items are not placed in the rear pocket.

In addition to the those drawbacks, it can be difficult for the escort to assist patients into or out of conventional wheelchairs. In either situation, the escort must bend over while supporting at least part of the patient's weight. Such an action can cause escort back injuries. Even when such injuries are not sustained, the act of assisting the patient into or out of the chair can require significant strength, which may not be possessed by the escort. It can also be physically straining for patients to get into and out of conventional wheelchairs, particularly if these patients are in a physically weakened condition due to age, illness, or injury.

A further drawback of conventional wheelchairs is that they take up a large amount of space when not in use and tend to be left in disarray in hospital hallways such that they impede personnel and hospital equipment. Furthermore, the footrests of conventional wheelchairs are detachable and tend to get lost. Moreover, conventional wheelchairs are easily stolen.

A further drawback of conventional wheelchairs is that they cannot recline. Sitting upright for long periods of time can be fatiguing to patients with weakened core muscles, spinal injuries, and the like. Conventional wheelchairs might be adequate for relatively robust patients who are unable to walk over long periods of time, but in practice wheelchairs are used to transport patients with more serious disabilities. As a matter of practical usage wheelchairs are not merely used to transport a patient from one place to another, but often the patient must wait for long periods of time in the wheelchair waiting for medical attention, such as when a patient is taken from the hospital room to a busy radiology center.

In view of the above-described drawbacks, it can be appreciated that it would be desirable to have alternative means for transporting individuals, such as hospital patients, from place to place.

BRIEF DESCRIPTION OF THE DRAWINGS

The disclosed transport chair embodiments can be better understood with reference to the following figures. It is noted that the components illustrated in the figures are not necessarily drawn to scale.

DETAILED DESCRIPTION

Figure 1:
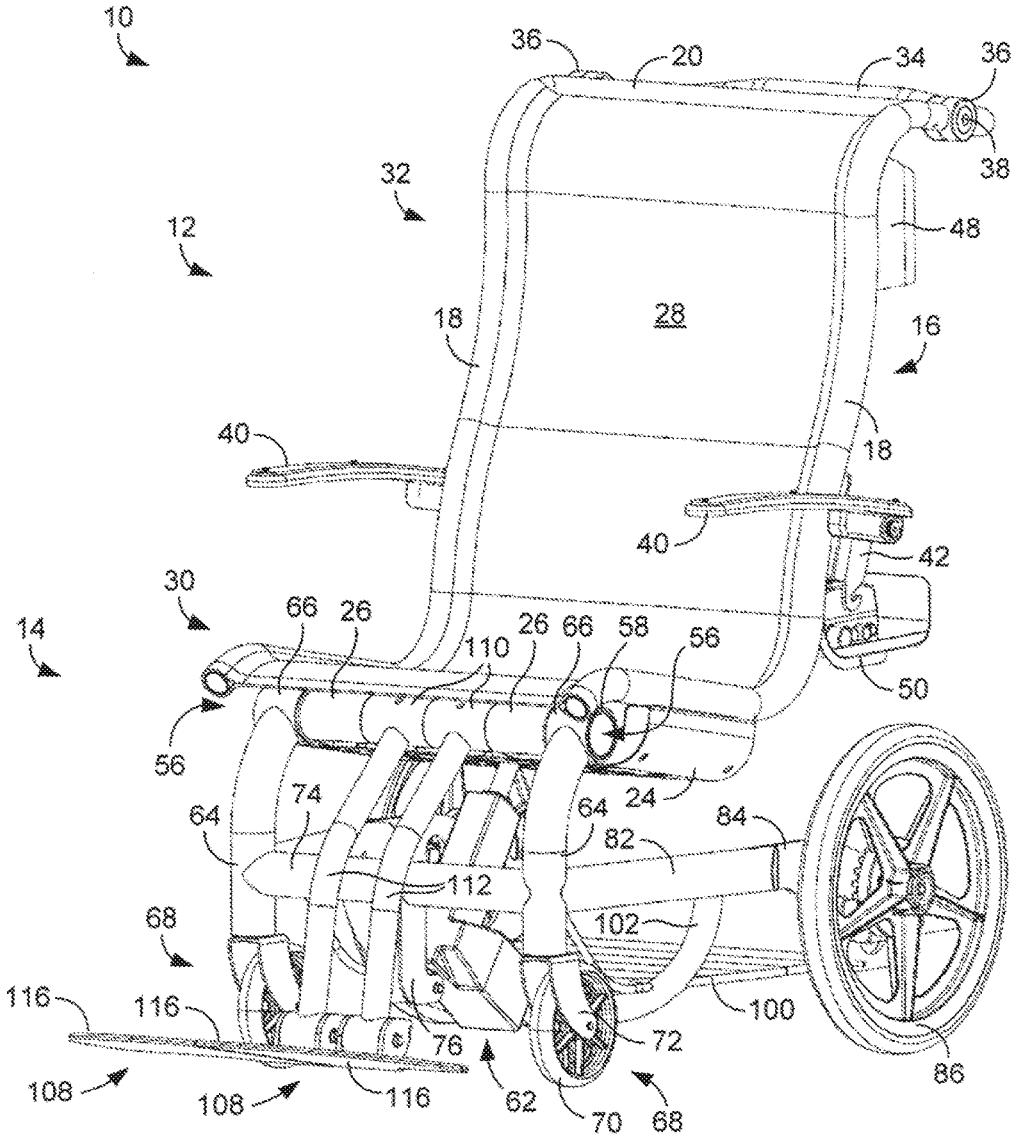
FIG. 1 is a front perspective view of an example embodiment of a transport chair.

As described above, conventional wheelchairs have several drawbacks when used to transport individuals, such as hospital patients, from place to place. Disclosed herein are transport chairs that are specifically designed for transporting such individuals with the maximum comfort while simultaneously reducing the effort required by the individuals and the chair operators (e.g., hospital escorts) and thereby reducing the opportunity for injury. In some embodiments, the transport chairs comprise a seat assembly that is supported by a base frame and that can pivot relative to the base frame about a pivot axis located near the front edge of the chair's seat. Such pivoting capability not only makes moving patients into and out of the chair much easier (particularly for patients with weakened legs or balance problems) but also facilitates chair nesting that significantly reduces the amount of space required for storage of the chairs.

In this disclosure, particular embodiments are described and illustrated. It is noted those embodiments are mere examples and that many other variations are possible. The present disclosure is intended to include all such variations.

FIGS. 1-6 illustrate an example embodiment of a transport chair 10. Generally speaking, the transport chair 10 includes a seat assembly 12 that is supported by a base frame 14. The seat assembly 12 comprises a seat frame 16 that includes multiple frame members, which can be configured as hollow metal (e.g., steel or aluminum) tubes. For the purposes of this discussion, the frame members will be referred to as tubes. The seat frame 16 includes two opposed side tubes 18, and a top cross tube 20, a rear cross tube 22, and a bottom support component or tray 24, each of which extends between the two side tubes. As is described below, at least one seat assembly tube section 26 is attached to the bottom tray 24 to facilitate articulation of the seat assembly 12.

Extending between the side tubes 18 is a support element 28 that supports the user (patient) when being transported in the chair 10. In some embodiments, the support element 28 comprises a flexible material that both conforms to the patient's body and facilitates air circulation so as to increase patient comfort. By way of example, the support element 28 comprises a hospital-grade vinyl fabric or mesh. Irrespective of the particular nature of the support element 28, the side tubes 8 can be continuous so as to form both a lower portion or seat 30 of the chair 10 and an upper portion or backrest 32 of the chair. In some embodiments, the backrest 32 forms a fixed angle with the seat 30 that is greater than 105 degrees. Such an angle is known as an "open hip angle" and not only increases patient comfort by enabling proper positioning of the spine but further facilitates entry into and exit from the transport chair 10. In some embodiments, the side tubes 18 form a seat profile based on the Grandjean curve, which is specifically designed to provide maximum comfort for all body sizes. Although the seat 30 and backrest 32 have been described and shown as being formed by the continuous side tubes 18, and therefore define a fixed angle between them, separate tubes or other members could be provided for the seat and backrest to enable adjustment of the angle between the backrest and the seat.

As is further illustrated in the figures, the lower and upper portions of the side tubes 18, which pertain to the seat 30 and the backrest 32, respectively, are individually curved. Specifically, the lower portions of the side tubes 18 curve downward at the front of the seat 30 to accommodate the bend of the patient's knees and curve upward at the rear of the seat to accommodate the bend of the patient's hips and to transition into the backrest 32. The upper portions of the side tubes 18 curve slightly forward near the lower-middle portion of the backrest 32, curve slightly rearward near the upper-middle portion of the backrest, and curve slightly forward again near the top of the backrest accommodate the natural curvature of the spine and to provide support to the shoulders (and head for smaller patients). In addition, the top ends of the side tubes 18 extend rearward from the support element 28 toward the chair operator.

Figure 2:
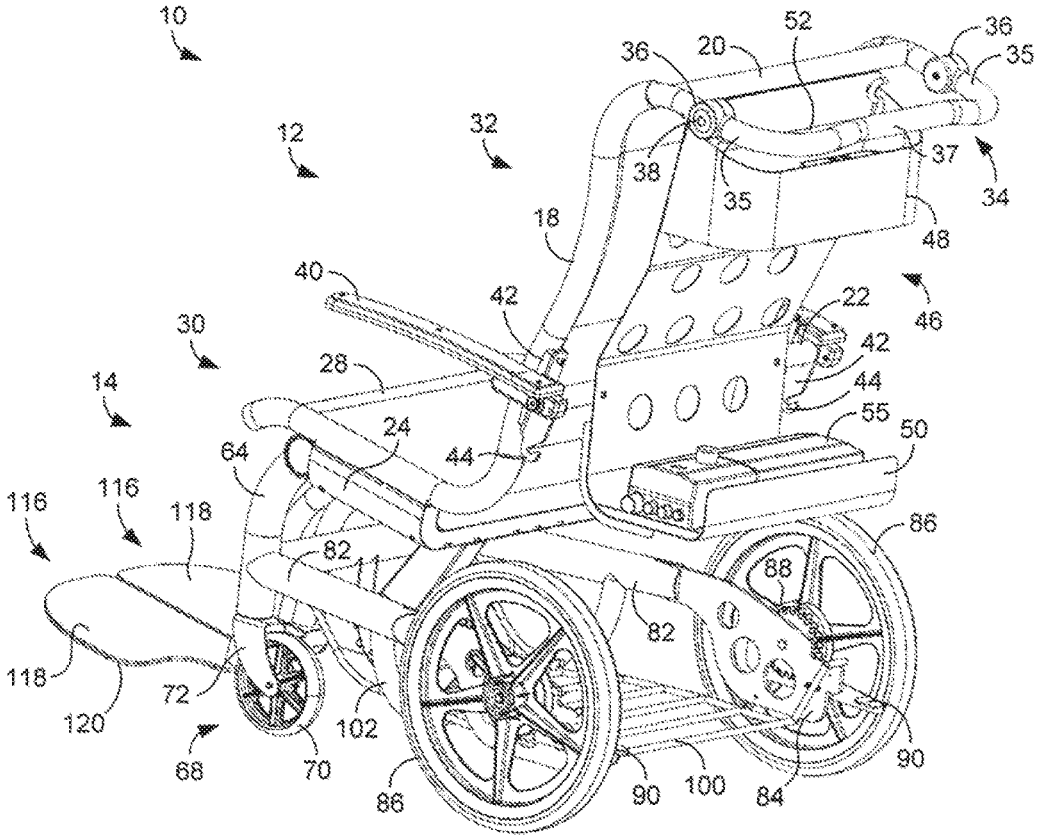
FIG. 2 is a rear perspective view of the transport chair of FIG. 1.
Figure 3:
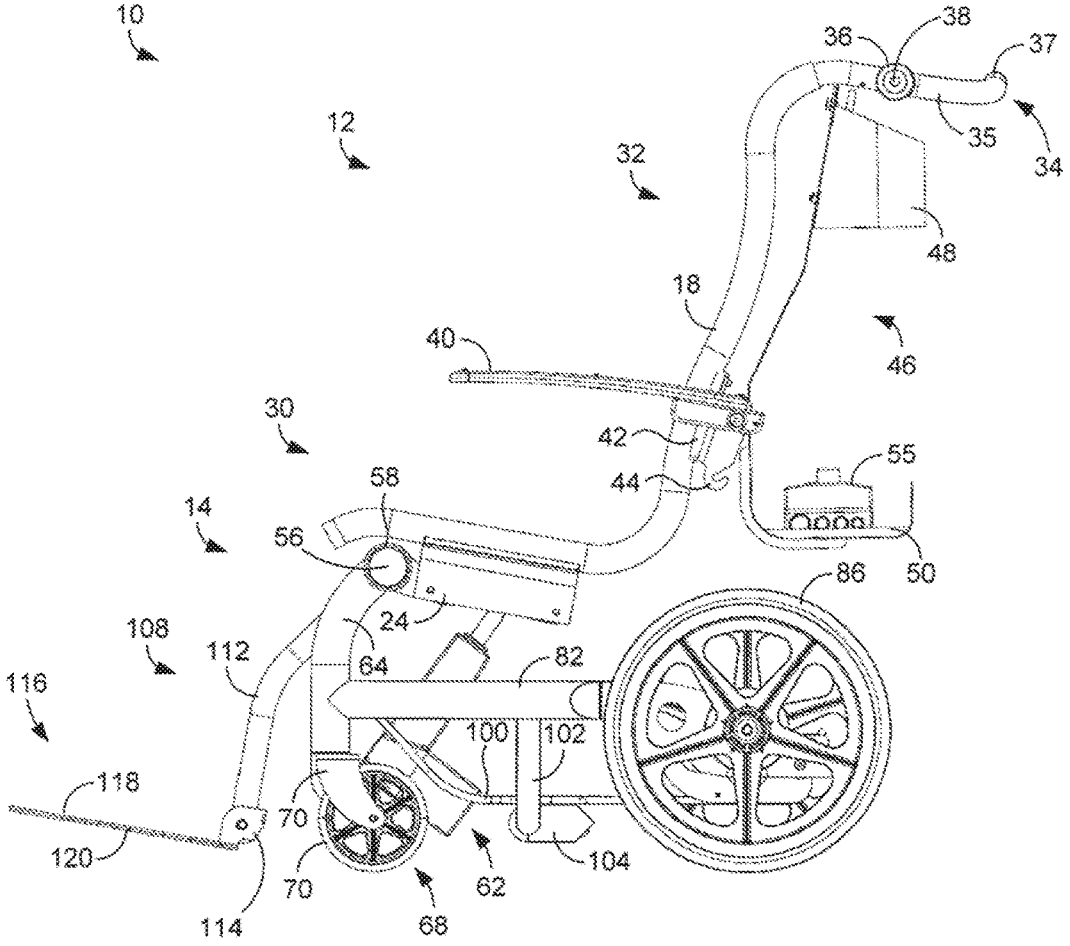
FIG. 3 is a side view of the transport chair of FIG. 1.

With particular reference to FIGS. 2 and 3, extending backward from the top ends of the side tubes 18 and extending laterally between the side tubes is an operator handle 34 that can be used by the chair operator to move the transport chair 10. In some embodiments, the handle 34 comprises side portions 35 that extend rearward from the side tubes 18 and a laterally-extending portion 37 that extends between the side portions and that forms the grip of the handle. Because the handle 34 extends back from the side tubes 18, which themselves extend back from the support element 28, the position of the handle ensures that the chair operator has plenty of space for the operator's feet and legs when walking with the chair 10. In addition, because the handle 34 incorporates a laterally-extending portion 37 for a grip, the handle is much easier to grasp than wheelchair handles.

The handle 34 is pivotally connected to the side tubes 18 and can be angularly adjusted to suit the height of the operator and/or to account for the recline angle of the seat assembly 12. In the illustrated embodiment, the adjustability is enabled by pivot joints 36 that are in a normally locked orientation but which can be adjusted when release buttons 38 on the sides of the pivot joints are depressed and held. By way of example, the laterally-extending portion 37 of the handle 34 can be articulated from a 60 degree declination angle to a 60 degree inclination angle, thereby providing approximately eight inches of vertical adjustment. As is shown best in FIGS. 2 and 5, the laterally-extending portion 37 of the operator handle 34 can be economically curved to suit the natural positions of the operator's outstretched hands.

Also mounted to the side tubes 18 are opposed armrests 40. In the illustrated embodiment, the armrests 40 are mounted to the side tubes 18 with mounting brackets 42 that are fixedly secured to the rear sides of the side tubes. In some embodiments, the armrests 40 are pivotally mounted to the mounting brackets 42 so that they can be articulated from a bottom, generally horizontal position at which they are generally parallel to the seat 30 to a top, generally vertical position at which they are generally parallel with the backrest 32 and therefore out of the way of the patient. In some embodiments, the mounting brackets 42 each comprise an attachment element 44, for example a hook, that is configured to receive and secure a bottom rack of the transport chair 10, which is described below. As is also described below, such receipt and securing facilitates nesting of the transport chair 10.

Figure 6:
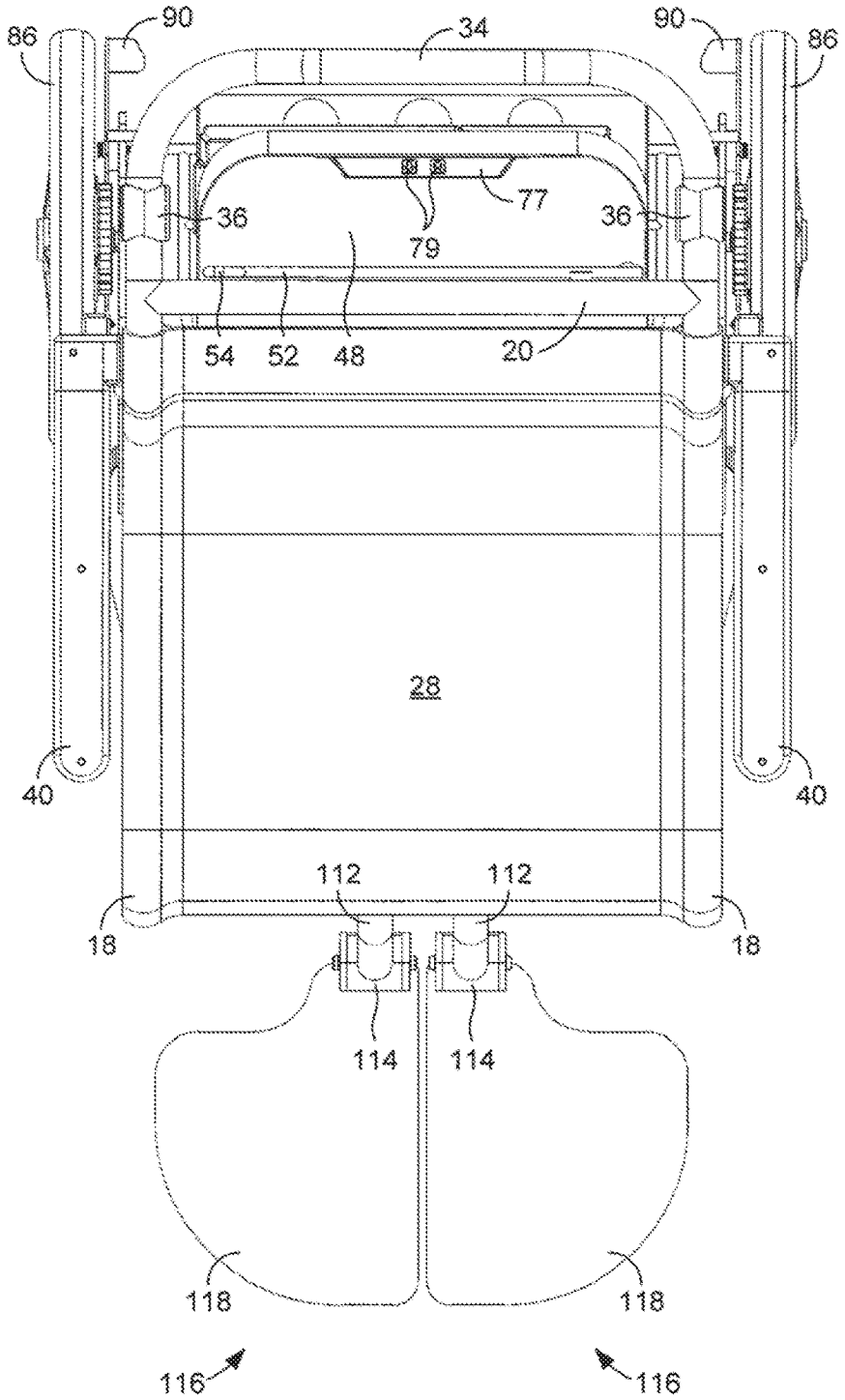
FIG. 6 is a top view of the transport chair of FIG. 1.

As is shown best in FIGS. 2 and 3, the transport chair 10 optionally includes a rear storage component 46 that can be used to store various items, such as the patient's personal items, medical documents and equipment, or a power source for the chair's motorized lifting mechanism (when provided). The rear storage component 46 can be fabricated from sheet metal (e.g., steel or aluminum) or a plastic material and, as illustrated in the figures, can be secured to the top and rear cross tubes 20, 22 of the seat assembly 12. As is further illustrated in the figures, the rear storage component 46 can define an upper storage compartment 48 in the form of a large pocket and a lower storage compartment 50 in the form of a flat tray. As is shown in FIGS. 2 and 6, the storage component 46 can contain an integral IV pole 52 that can be manually extended from a horizontal, stowed position (shown in the figure) to a vertical, extended position (not shown) so that an IV bag or other component can be hung from a hook 54 of the pole. In the illustrated embodiment, the lower storage compartment 50 supports a power source 55 (e.g., battery) for the lifting mechanism.

As described above, the seat assembly bottom tray 24 extends between the two side tubes 18. More specifically, the bottom tray 24 extends below the seat 30 between the lower portions of the side tubes 18. The bottom tray 24, like the cross tubes 20, 22, provides structural integrity to the seat assembly 12. In addition, the bottom tray 24 facilitates pivoting of the seat assembly 12 about a front pivot axis 56 of the transport chair 10 located near the front edge of the seat 30. In particular, the bottom tray 24 supports at least one horizontal seat assembly tube section 26 that is fixedly mounted on and concentric with a horizontal pivot shaft 58 that is concentric with the pivot axis 56 and therefore has a central longitudinal axis that is coincident with and defines the pivot axis. In some embodiments, the shaft 58 comprises a hollow metal (e.g., steel) tube. In the illustrated embodiment, there are two seat assembly tube sections 26. Because the tube sections 26 are fixedly connected to the bottom tray 24, which supports the seat assembly 12, the seat assembly can rotate or pivot about the pivot axis 56 with the pivot shaft 58. As described below with reference to FIGS. 10A-10D, the seat assembly 12 can be positioned in any number of orientations between a fully reclined position and a fully inclined (or forward titled) position. In the illustrated embodiment, the tube sections 26 are mounted to the bottom tray 24 with flanges 60 that extend from the tray to the tube sections (see FIGS. 8 and 11A).

The bottom tray 24 also facilitates pivoting of the seat assembly 12 because the bottom tray serves as the attachment point for a lifting mechanism 62 that assists the operator with pivoting the seat assembly about the pivot axis 56. An embodiment for the lifting mechanism 62 and its operation are described below.

The base frame 14, like the seat frame 16, comprises multiple frame members, which can be configured as hollow metal (e.g., steel or aluminum) tubes. For the purposes of this discussion, the base frame members will also be referred to as tubes. As indicated most clearly in FIGS. 1 and 4, the base frame 14 includes to two opposed, generally vertical front tubes 64. Located at the top ends of the front tubes 64 are horizontal base frame tube sections 66 that, like the seat assembly tube sections 26, are mounted on the pivot shaft 58. Unlike the seat assembly tube sections 26, however, the base frame tube sections 66 are not fixed to the pivot shaft 58 such that the pivot shaft can rotate independent of the base frame tube sections. With this configuration, the front tubes 64 support the pivot shaft 58, and therefore the seat assembly 12 that is mounted to the shaft 58.

Connected to the bottom ends of the front tubes 64 are front wheel assemblies 68. As is shown in the drawings, the front wheel assemblies 68 are each configured as a caster wheel that includes a wheel 70 that can rotate about a horizontal axis and a bracket 72 that can rotate about a vertical axis. By way of example, the wheel 70 comprises a resilient outer surface made of rubber or a polymer with similar properties.

Extending between the front tubes 64 is a generally horizontal front cross tube 74. The front cross tube 74 provides structural support to the front tubes 64 and further supports the lifting mechanism 62 with downward extending mounting flanges 76 to which the lifting mechanism 62 is pivotally mounted. Although capable of alternative construction, the lifting mechanism 62 can comprise an internal electric motor (not visible) contained within an outer housing 78 that linearly drives a shaft 80 that is pivotally connected to the bottom tray 24 of the seat assembly 12. When the motor is driven to extend the shaft 80 from the housing 78, the bottom tray 24 is moved upward and the seat assembly 12 pivots forward about the pivot axis 56. In contrast, when the motor is driven to retract the shaft 80 into the housing 78, the bottom tray 24 is moved downward and the seat assembly 12 pivots backward about the pivot axis 56.

FIG. 6 illustrates an example controller 77 that can be used to actuate the lifting mechanism 62. As is shown in that figure, the controller 77 is mounted within the upper storage compartment 48 of the rear storage component 46 and includes up and down push buttons 79. Although the controller 77 is shown as being integrated with the rear storage compartment 48, in other embodiments the controller can be connected to a long (e.g., 8-10 foot long) cable that enables the operator to remotely actuate the lifting mechanism 62 from a position other than behind the chair 10. For example, the cable would enable the operator to actuate the lifting mechanism 62 from the front of the chair 10 so that the operator could actuate the lifting mechanism and assist the patient at the same time. In still other embodiments, the controller 77 can be a wireless controller.

Figure 5:
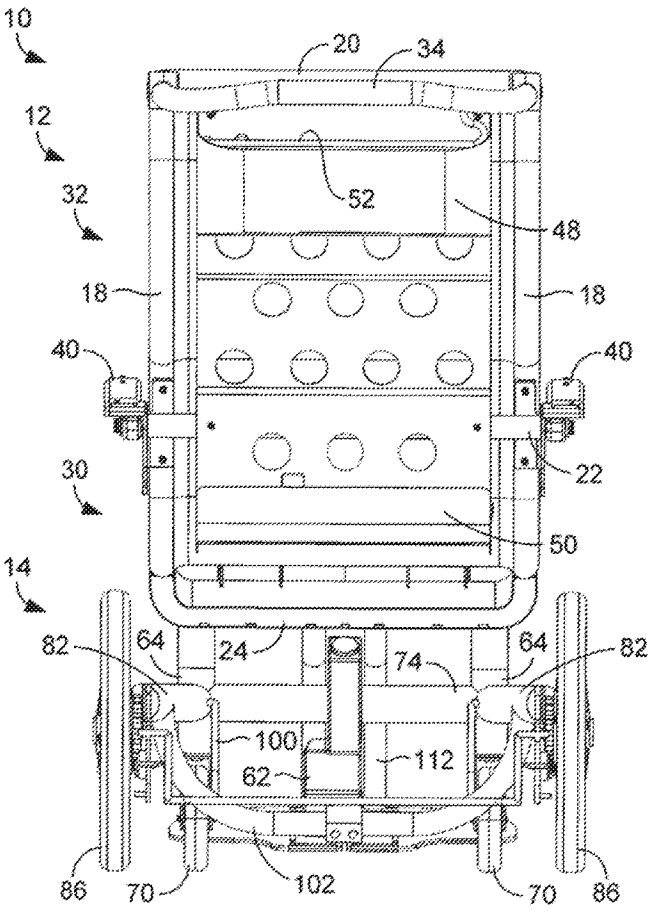
FIG. 5 is a rear view of the transport chair of FIG. 1.
Figure 4:
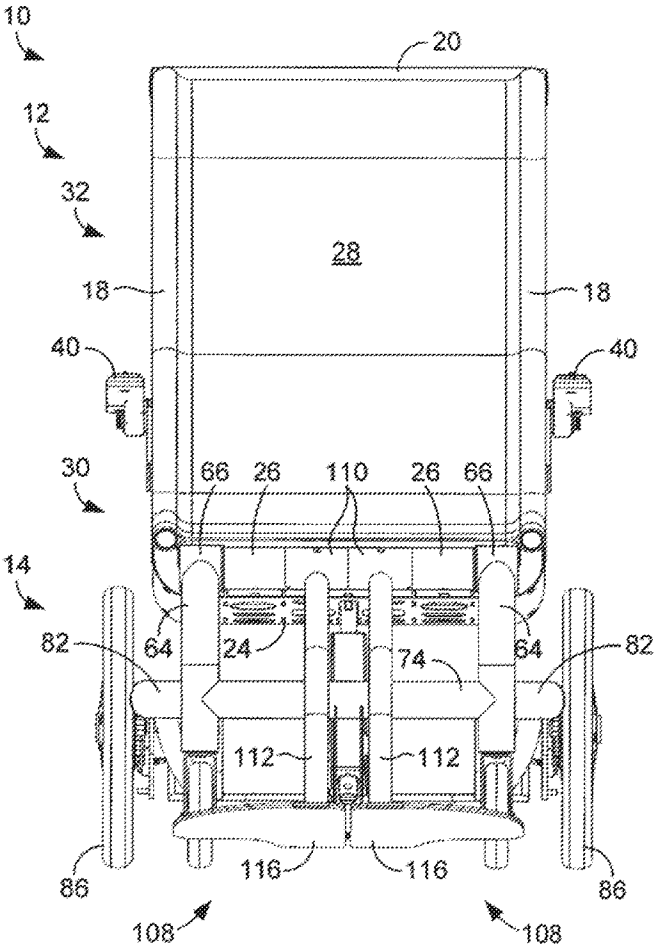
FIG. 4 is a front view of the transport chair of FIG. 1.

Extending rearward from the front tubes 64 are two opposed, generally horizontal side tubes 82. In embodiments in which the transport chair 10 can nest with like chairs, the side tubes 82 extend outwardly at an angle from the front tubes 64 as shown in FIG. 5 to provide room for another chair to fit between the side tubes. As is shown best in FIG. 2, the side tubes 82 each terminate in a vertical rear flange 84 to which a rear wheel 86 is mounted. The rear wheels 86 in this embodiment are significantly larger than the front wheels 70 but, as with the front wheels, can each comprise a resilient outer surface made of rubber or a polymer with similar properties. Fixedly mounted to the inside of each wheel 86 is a toothed hub 88. A brake element (not visible in the figures) that is operated by a foot pedal 90 positioned adjacent the wheel 86 can engage the teeth of the hub 88 to provide independent positive braking for each wheel 86. Although independent braking has been described, the brake element associated with each wheel 86 can be simultaneously operated by a single foot pedal 90 in alternative embodiments.

Extending beneath the seat assembly 12 is a bottom storage component in the form of a bottom rack 100. The front end of the rack 100 is pivotally mounted to the side tubes 82 near the point at which the side tubes connect to the front tubes 64 (see FIG. 5) and the rear end of the rack is supported by (rests upon) the rear flanges 84 of the side tubes 82. With this configuration, the rear end of the bottom rack 100 can be lifted up from the rear flanges 84 and connected to the attachment element 44 for nesting purposes (see FIGS. 11A and 11B). In the illustrated embodiment, the rack 100 is constructed as a metal wire frame.

Extending down from and between the side tubes 82 is a U-shaped central cross tube 102. The central cross tube 102 provides structural support to the side tubes 82 and further supports a stop member 104 that is pivotally mounted thereto. As is described below, the stop member 104 is used to prevent footrests of another transport chair from damaging the lifting mechanism 62 when an operator improperly attempts to nest the chair without first folding up the footrests of the rear chair. In the retracted or undeployed position shown in FIGS. 3 and 5, the stop member 104 is lifted up off the floor or ground and is suspended from the bottom rack 100 due to magnetic attraction between a magnet provided on the stop member 104 and the metal of the bottom rack (or associated magnet of the rack if provided). When the bottom rack 100 is lifted upward to facilitate nesting, the magnetic coupling is broken and the stop member 104 drops down to the floor or ground under the force of gravity to assume an extended or deployed position that ensures that the footrest of a potentially nesting chair is blocked.

In addition to the seat assembly 12, the pivot shaft 58 of the base frame 14 also supports at least one footrest assembly 108. Although a single footrest assembly 108 can be provided to support both of the patient's feet, the illustrated embodiment includes two footrest assemblies, one for each foot. Each footrest assembly 108 includes a horizontal footrest assembly tube section 110 that is mounted on and concentric with the pivot shaft 58. Unlike the seat assembly tube sections 26, however, the tube sections 110 are free to rotate about the pivot shaft 58. Extending from each footrest assembly tube section 110 is a leg 112 that is similar in length to a human lower leg. Pivotally mounted to the bottom end of each leg 112 with a pivot joint 114 is footrest 116. In some embodiments, the footrests 116 each comprise a generally planar metal plate 118. Attached to the bottom surface of each plate 118 is a layer of resilient slip-resistant material 120 that, as described below, acts as a further brake for the transport chair 10 when a patient enters or exits the chair.

Figure 7:
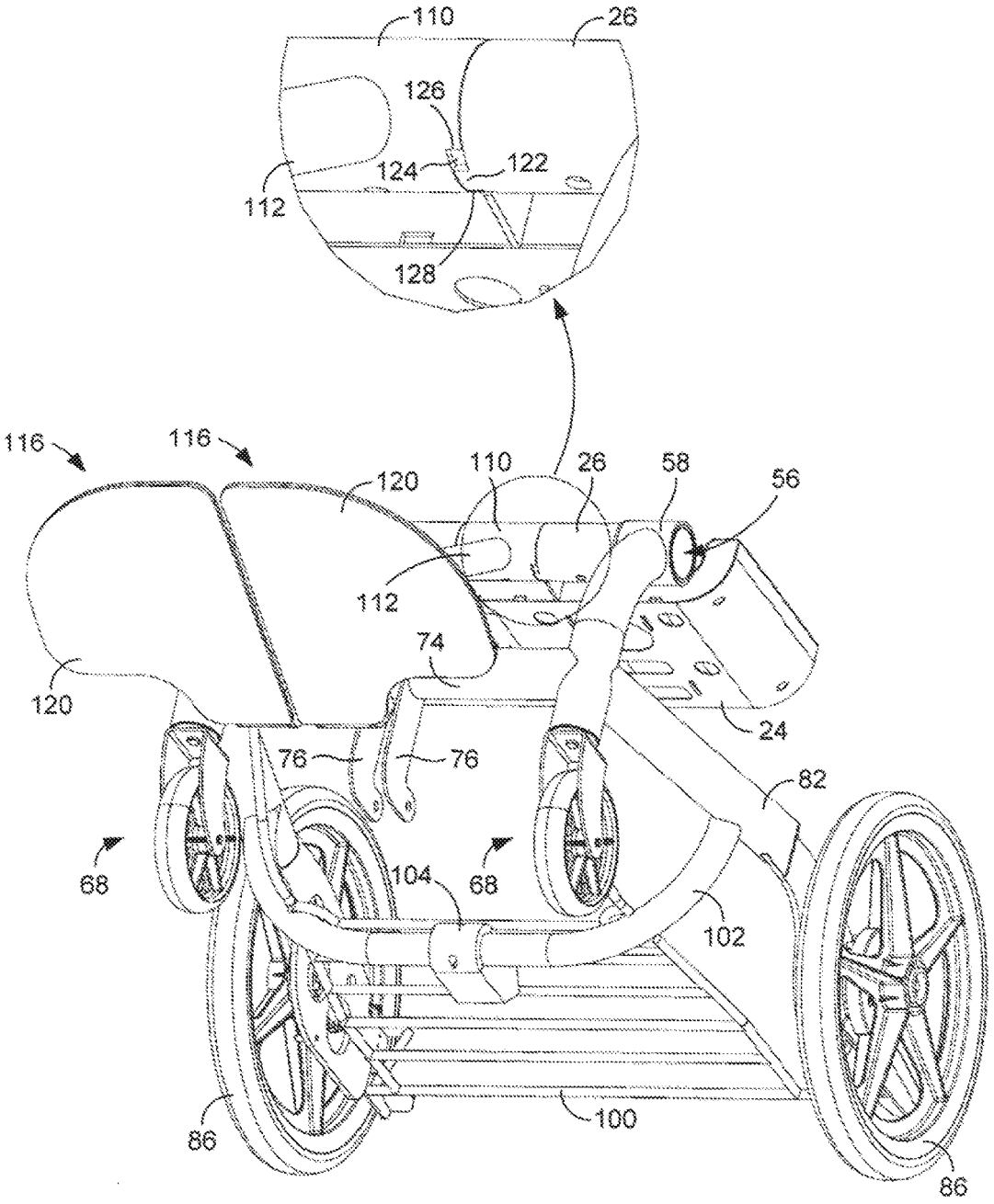
FIG. 7 is a bottom perspective view of a base frame, a seat assembly bottom tray, and footrest assemblies of the transport chair of FIG. 1.
Figure 8:
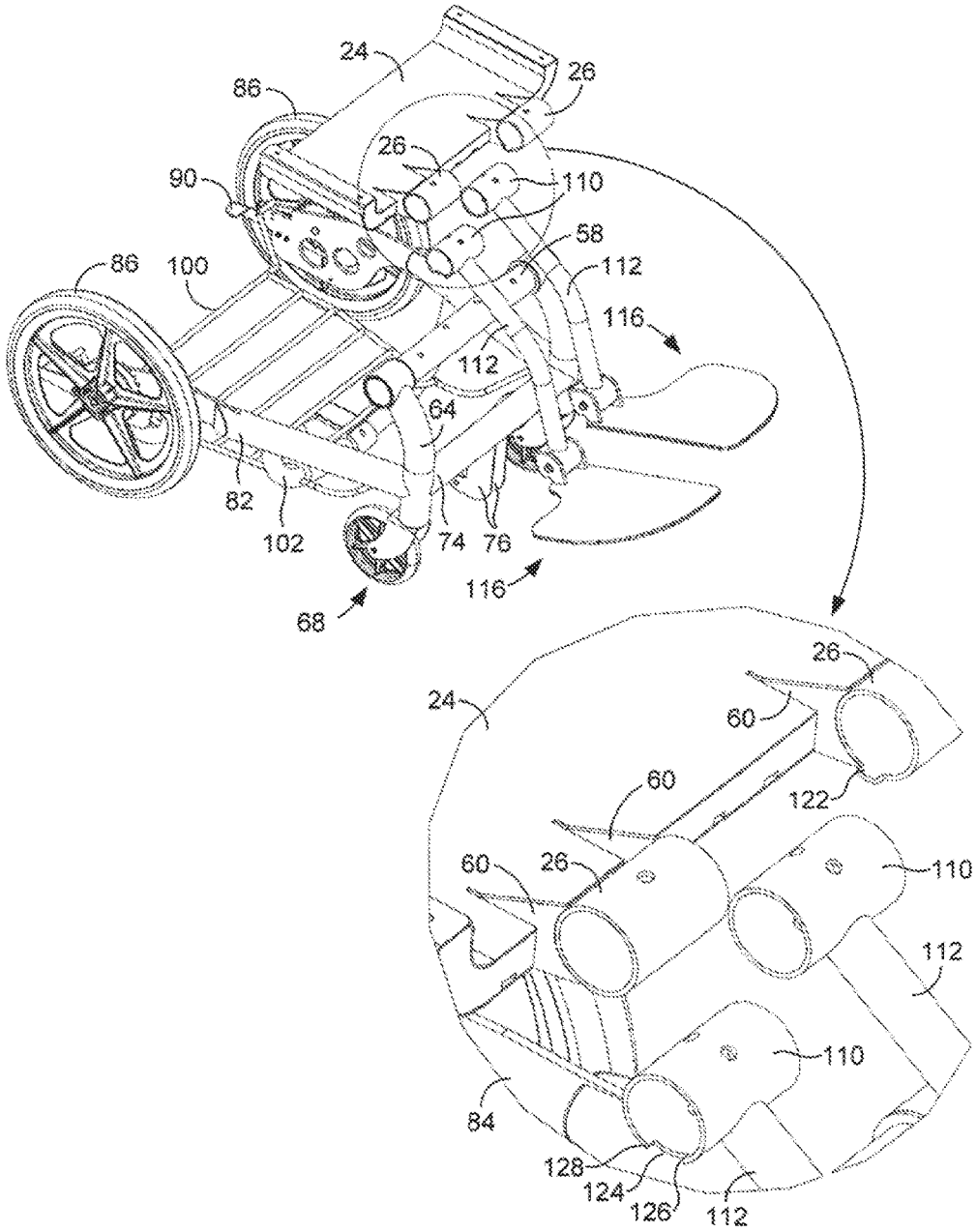
FIG. 8 is a top perspective view of the base frame, seat assembly bottom tray, and footrest assemblies of the transport chair of FIG. 1 with the footrest assemblies shown separated from the base frame.

In some embodiments, the footrest assemblies 108 pivot in unison with the seat assembly 12 until they contact the floor or ground, at which point the patient can stand on the footrests and get into or out of the chair 10. In the illustrated embodiment, such functionality is provided by key and slot apparatuses defined by the seat assembly tube sections 26 and the footrest assembly tube sections 110. Example key and slot apparatuses are illustrated in FIGS. 7 and 8, which show the base frame 14 (with the lifting mechanism 62 removed), the bottom tray 24 of the seat assembly 12, and the footrest assemblies 108. Specifically, illustrated are the key and slot apparatuses defined by pairings of seat assembly tube sections 26 and footrest tube sections 108.

As is shown in FIGS. 7 and 8, a key 122 in the form of a rectangular and arcuate tab extends from the inner edge of each seat assembly tube section 26 toward its adjacent footrest tube section 10. The key 122 is received within an arcuate slot 124 that is provided along the outer edge of the footrest tube section 110 that faces the adjacent seat assembly tube section 26. Each slot 124 has a top end 126 and a bottom end 128 and the key 122 can travel along the slot and at least engage the top end of the slot. The key and slot pairs are angularly positioned on the tube sections 26, 110 such that when the seat assembly 12 is reclined past a predetermined point (e.g., past a point at which the seat 30 is horizontal), the key 122 engages the top end 126 of the slot 124 and continued reclining of the seat assembly will lift the footrest assemblies 108 off of the floor or ground so that the footrest assemblies will pivot in unison with the seat assembly. When the seat assembly 12 is pivoted forward again to the extent at which the footrests 116 again are supported by the floor or ground, the footrest assemblies 108 will "break" from the seat assembly and they will remain stationary even if the seat assembly continues to be pivoted forward. During such continued pivoting, the key 122 of the seat assembly tube section 26 travels unimpeded along the slot 124 of the footrest assembly tube section 110. An example of such operation is described in relation to FIGS. 10A-10D below.

Figure 9:
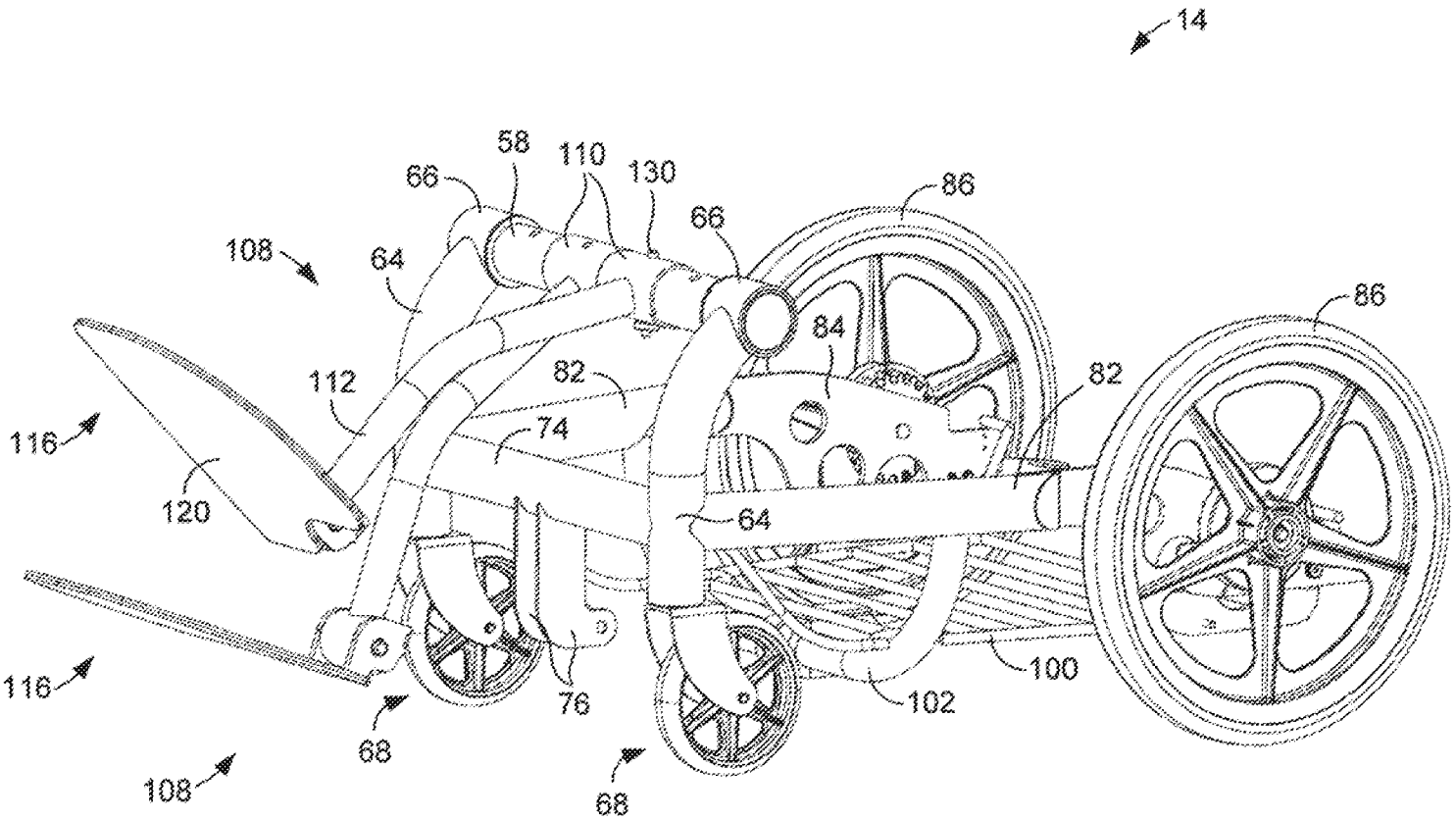
FIG. 9 is a front perspective view of the base frame and footrest assemblies of the transport chair of FIG. 1 illustrating locking of a footrest assembly in an elevated orientation.

In some embodiments, the footrest assemblies 108 can be independently locked in predetermined orientations relative to the seat assembly 12 to elevate one or both of the patient's feet. An example of such locking is illustrated in FIG. 9. That figure shows the base frame 14 of the transport chair 10 (with the lifting mechanism 62 removed) with the footrest assemblies 108 attached. As is shown in FIG. 9, the left footrest assembly 08 has been locked in an elevated orientation relative to the right footrest assembly 108 using a locking pin 130 that has been passed through openings formed in the left footrest assembly tube section 110 and the pivot shaft 58. When the pin 130 has been so placed, the footrest assembly 108 is fixedly connected to the pivot shaft 58 and will therefore move in unison with the seat assembly 12 (not shown), which is likewise fixed to the shaft.

Figure 10A:
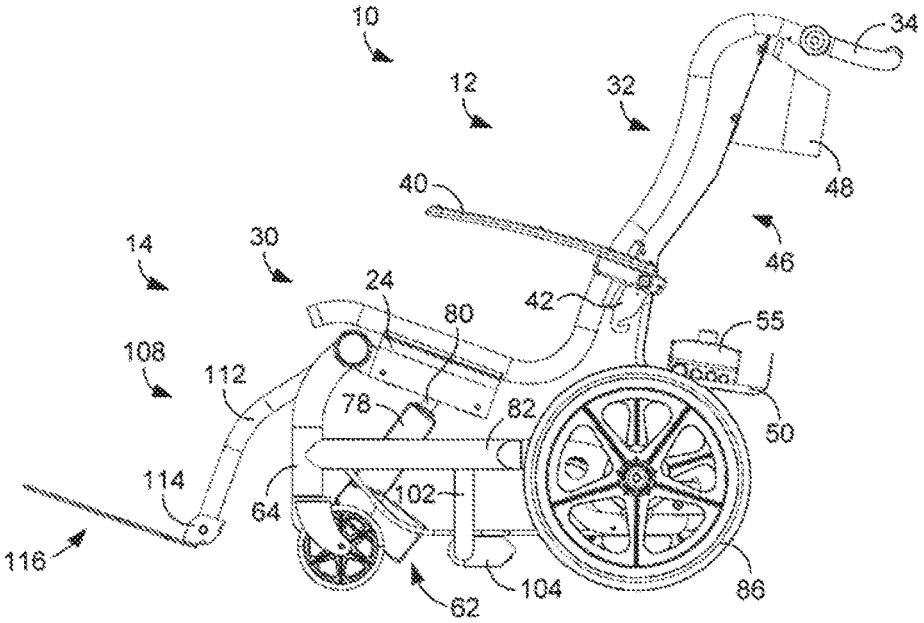
FIGS. 10A-10D are sequential side views illustrating the transport chair of FIG. 1 as its seat assembly is articulated from a fully reclined position to a fully inclined (forward tilted) position.
Figure 10B:
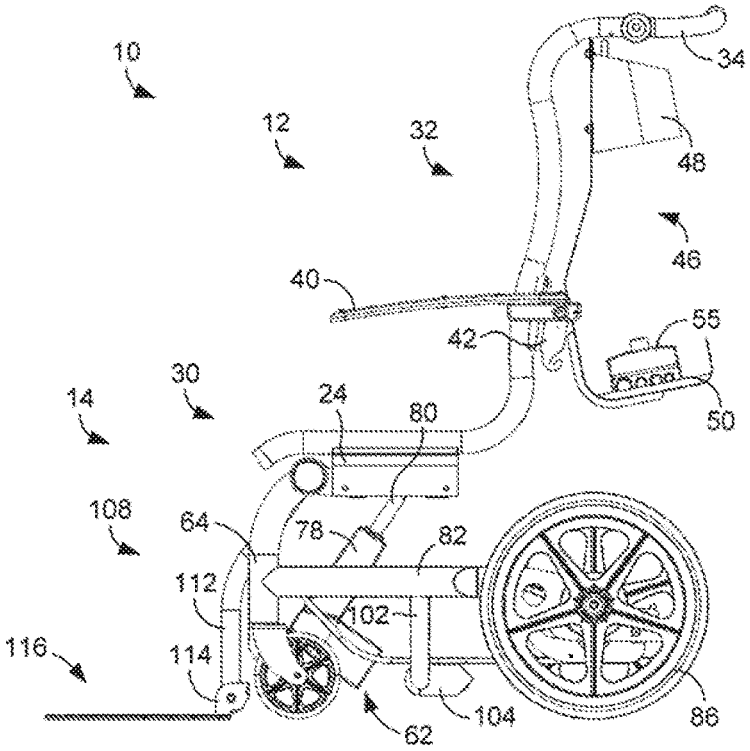

The construction of an example transport chair 10 having been described above, operation of the chair will now be discussed. As described above, the seat assembly 12 is infinitely adjustable between a fully reclined orientation in which a patient can sit in the chair 10 to a fully inclined or tilted forward orientation in which the patient can either get into or out of the chair. FIGS. 10A-10D show the seat assembly 12 being articulated from the fully reclined orientation (FIG. 10A) to the fully inclined or tilted forward orientation (FIG. 10D). As indicated in FIG. 10A, both the seat 30 and the backrest 32 are reclined when the seat assembly 12 is in the fully reclined orientation. In some embodiments, the seat 30 forms an angle with the horizontal plane of approximately 10 to 30 degrees and the backrest 32 forms an angle with the vertical plane of approximately 20 to 40 degrees when the seat assembly 12 has been fully reclined. By way of example, the seat 30 is reclined at an angle of approximately 20 degrees (from the horizontal plane) and the backrest 32 is reclined at an angle of approximately 30 degrees (from the vertical plane) in the fully reclined orientation. As is also shown in FIG. 10A, the footrest assemblies 108 are lifted up off of the floor or ground because of the aforementioned key and slot apparatuses.

When the lifting mechanism 62 is activated to extend the shaft 80, the seat assembly 12 will pivot forward about the pivot axis 56 and the recline angle of the seat assembly will be reduced. FIG. 10B shows the transport chair after the lifting mechanism 62 has been operated to bring the seat 30 to a horizontal orientation. As is also shown in that figure, the footrest assemblies 108 have pivoted downward as the seat assembly 12 has pivoted forward to the point at which the footrests 116 initially make contact with the floor or ground. Although the footrests 116 have been described and illustrated as first touching the floor or ground when the seat 30 is horizontal, it is noted that this relationship is merely exemplary and that the footrests may first touch the floor or ground when the seat is in another orientation.

Figure 10C:
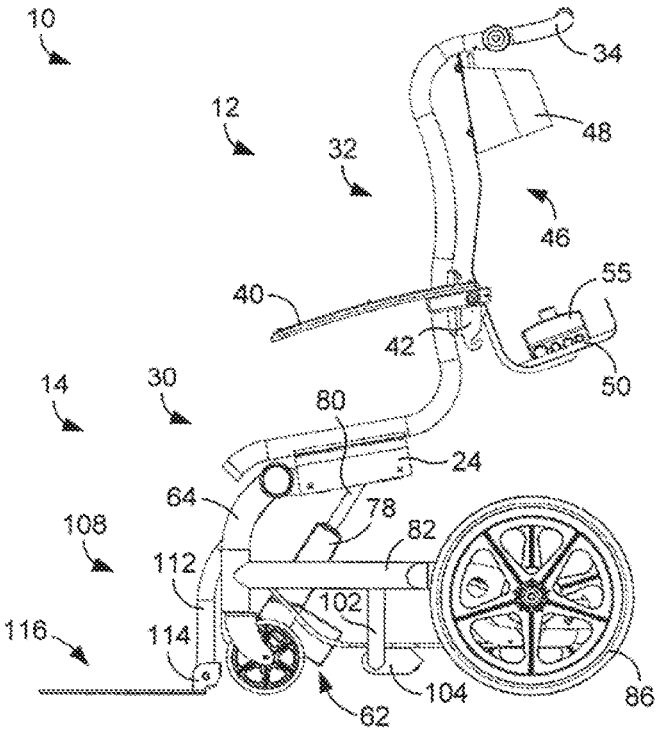
Figure 10D:
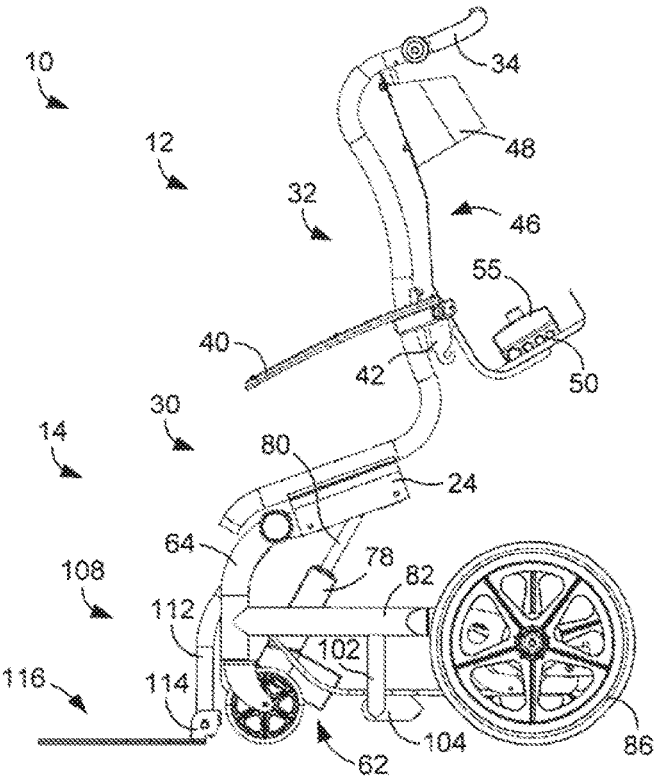

If the lifting mechanism 62 continues to operate, forward pivoting of the seat assembly 12 continues, as indicated in FIG. 10C, and both the seat 30 and backrest 32 will begin to tilt forward. Notably, however, the footrest assemblies 108 do not continue to pivot with the seat assembly 12 because they are now supported by the floor or ground.

FIG. 10D shows the seat assembly 12 in the fully inclined, or forward tilted, orientation. As is shown in that figure, the footrest assemblies 108 have not moved. In some embodiments, the seat 30 forms an angle with the horizontal plane of approximately −10 to −30 degrees and the backrest 32 forms an angle with the vertical plane of approximately 0 to −20 degrees when the seat assembly 12 is fully forward tilted. By way of example, the seat 30 is tilted forward at an angle of approximately −20 degrees (from the horizontal plane) and the backrest 32 is tilted forward at an angle of approximately −10 (from the vertical plane) degrees in the fully inclined orientation.

It is much easier for patients to get out of the transport chair 10 when the seat assembly 12 has been tilted forward as shown in FIG. 10D. Specifically, the pivoting of the seat assembly 12 places the patient in a more upright position that is closer to standing than the seated position of a conventional wheelchair. Therefore, less energy and leg strength are required to stand up. When the patient begins to stand up, the patient's weight is pressed down onto the footrests 116. This force presses the footrests 116 into firm contact with the floor or ground. This force, combined with the slip-resistant material 120 provided on the underside of the footrests 116, stabilizes the chair 10 as well as the patient as the patient leaves the chair. The forward tilt of the seat assembly 2 also reduces the energy or strength needed from someone (e.g., a hospital escort) who is called upon to assist the patient out of the chair 10.

The forward tilt of the seat assembly 12 also makes it easier for patients to get into the chair 10. Specifically, because the seat 30 is tilted forward and upward in the orientation shown in FIG. 10D, the patient does not need to drop down as far to sit as the patient would need to with a conventional wheelchair. This also makes for less work for the individual who assists the patient into the chair 10.

Figure 11B:
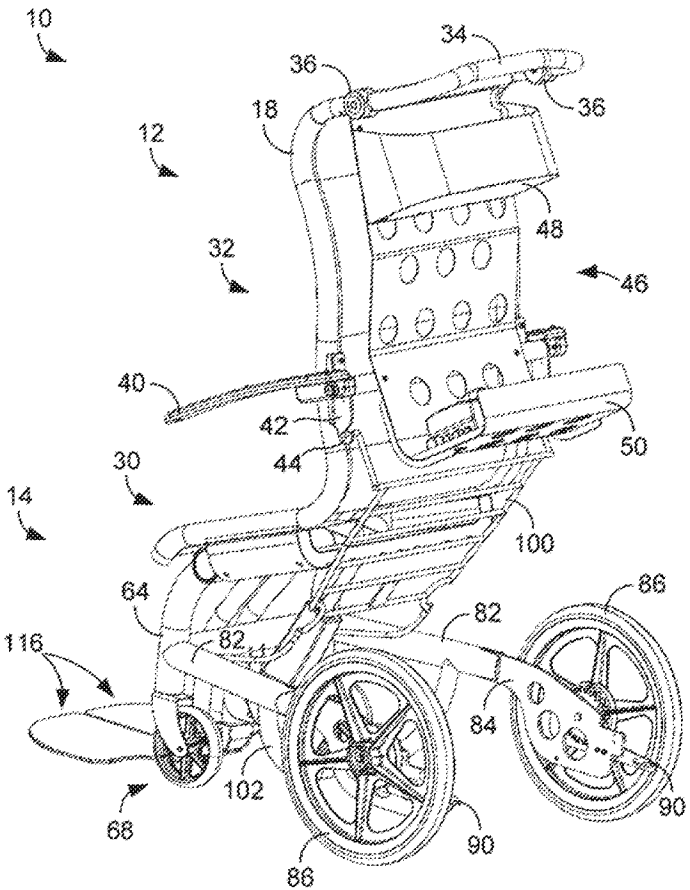
FIGS. 11A and 11B are further rear perspective views of the transport chair of FIG. 1 but with the chair shown in an inclined (forward tilted) position to illustrate attachment of a bottom rack to the seat assembly.
Figure 11A:
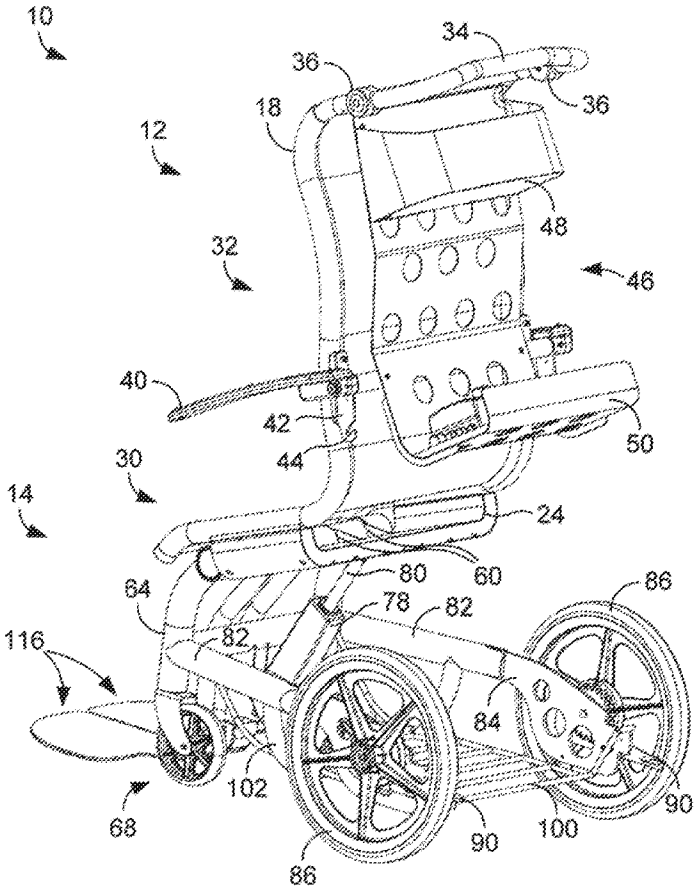

The pivoting of the seat assembly 12 not only facilitates patient entry into and exit from the transport chair 10 but also facilitates storing the chair by nesting. FIG. 11A shows the transport chair 10 from the rear when the chair is at or near the fully inclined (forward tilted) orientation. As shown in that figure, the bottom rack 100 is still supported by the rear flanges 84 of the side tubes 82 of the base frame 14. When the rack 100 is in that position, it occupies the space between the rear wheels 86 that could be used for nesting. If nesting is desired, the rack 100 can be manually pivoted upward and attached to the seat assembly 12 as indicated in FIG. 11B. Specifically, the rack 100 can be hung on the attachment elements 44 provided on the mounting brackets 42 connected to the side tubes 18 of the seat assembly 12. In some embodiments, such attachment is performed when the seat assembly 12 has been tilted forward just short of the fully forward tilted position. Once the rack 100 has been attached, the seat assembly 12 can be fully pivoted forward. Regardless, once the rack 100 has been connected to the seat assembly 12, the space between the rear wheels 86 is open and unobstructed.

When the bottom rack 100 is pivoted upward, the magnetic coupling that connects the footrest stop member 104 to the rack is broken and the stop member drops down to the floor or ground into its deployed position, as shown in FIG. 2. As described above, once deployed, the stop member 104 is positioned to block passage of the footrests 116 of another chair that someone may try to nest behind the chair 10 and therefore prevents the footrests from damaging the lifting mechanism 62. Because of the stop member 104, the footrests 116 of another chair that is to be nested behind the chair 10 must be folded upward prior to nesting.

Figure 12:
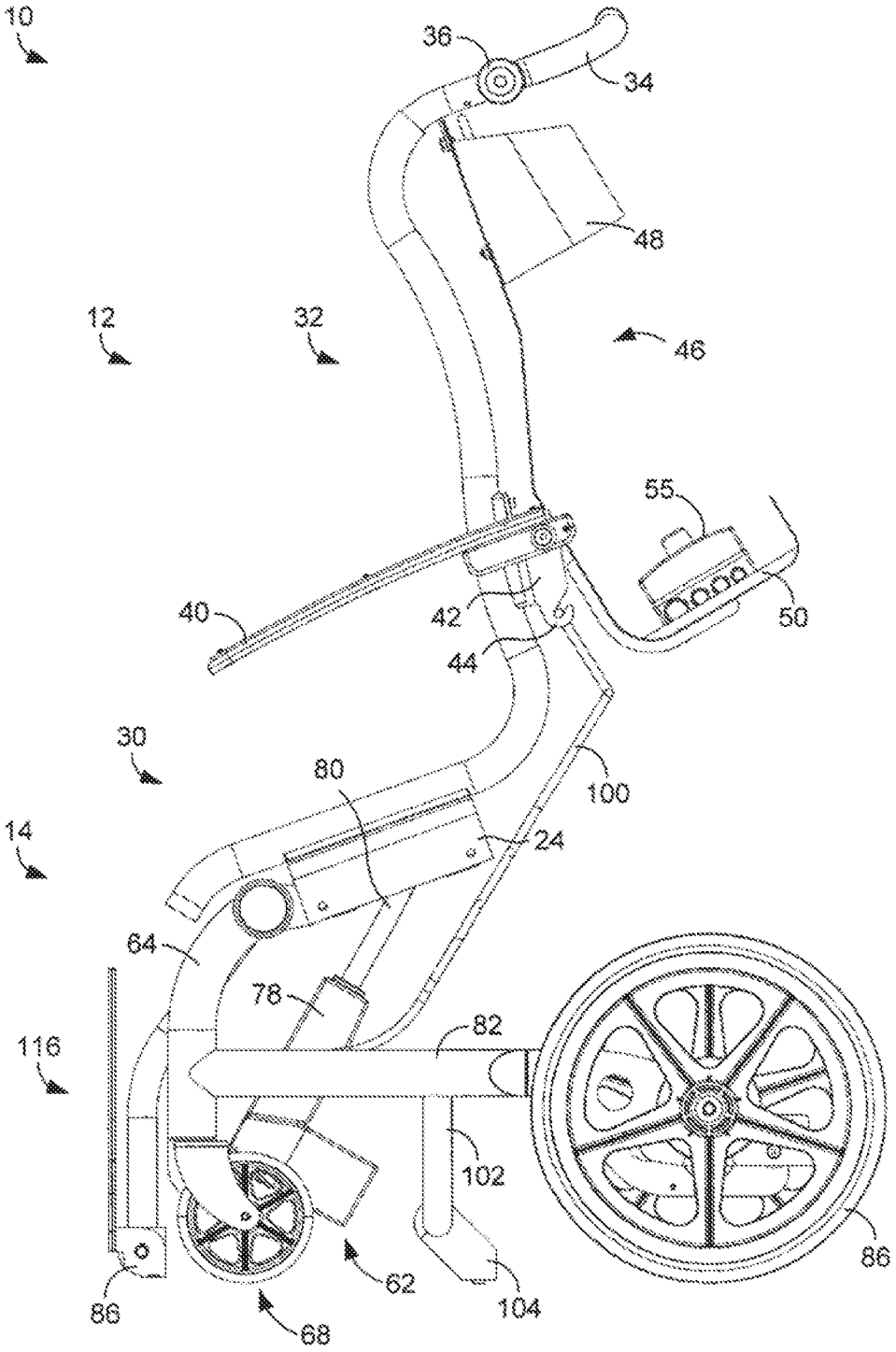
FIG. 12 is a side view of the transport chair of FIG. 1 with the bottom rack shown attached to the seat assembly and a footrest stop member deployed.

Such upward folding is illustrated in FIG. 12. Specifically, the footrests 116 have been pivoted through approximately 90 degrees so that they are moved from a generally horizontal orientation to a generally vertical orientation. In some embodiments, friction holds the footrests 116 in the vertical orientation to prevent them from unintentionally flopping down into the horizontal orientation.

Figure 13:
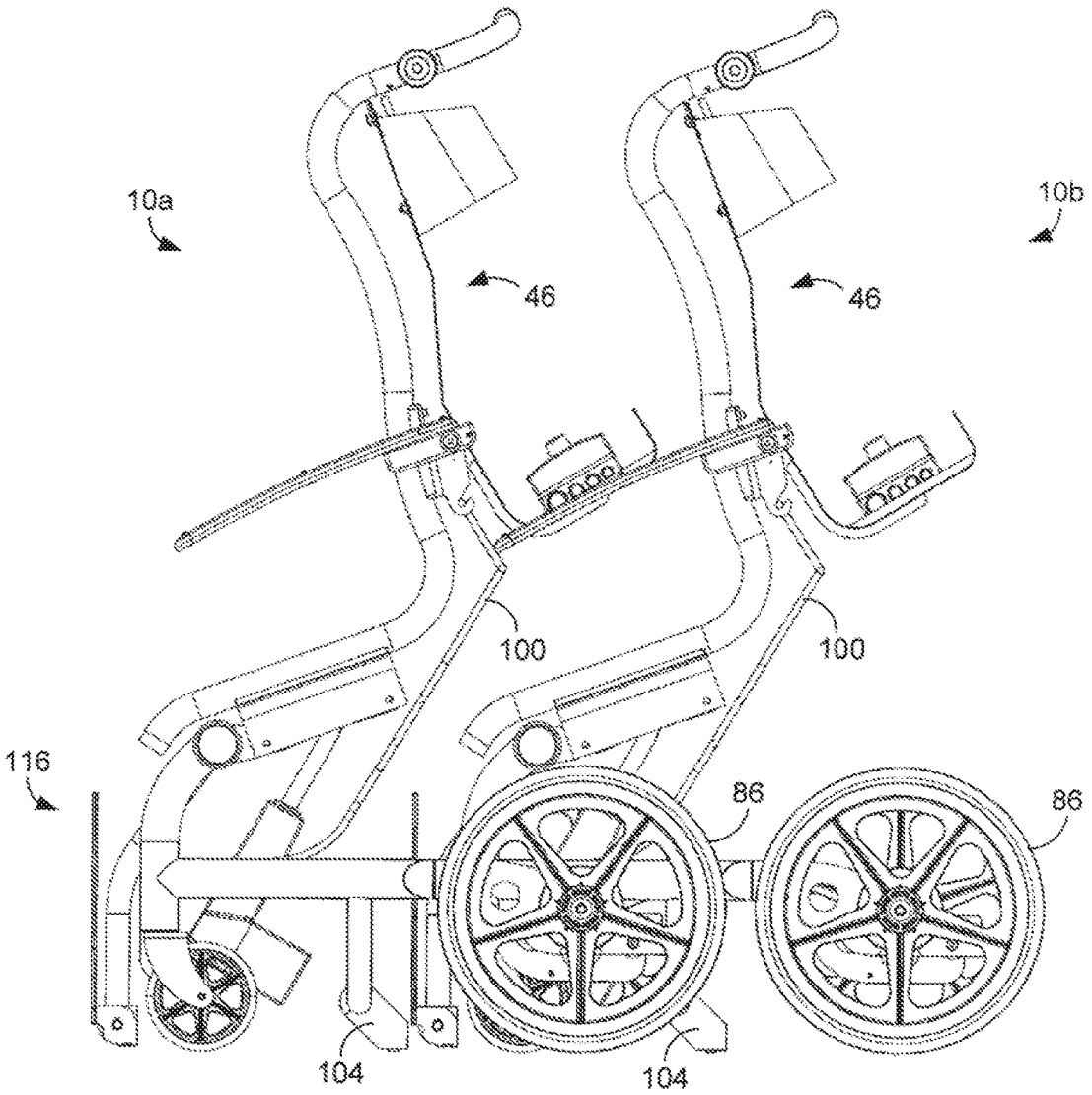
FIG. 13 is a side view of two transport chairs of the type shown in FIG. 1, the two transport chairs being nested for more compact and organized storage.

FIG. 13 illustrates nesting of two transport chairs: a front chair 10*a* and a rear chair 10*b*. As is shown in that figure, the rear chair 10*b* has been moved into the space between the rear wheels 86 of the front chair 10*a* so that the two chairs occupy less space than they would if they were stored separately. As is further shown in FIG. 13, the seat assembly 12 of the rear chair 10*b* does not occupy the space beneath the seat assembly 12 of the front chair 10*a*.

To place the chairs 10*a*, 10*b* in the orientation shown in FIG. 13, the chair operator can first position the front chair 10*a* in a desired storage location and set the brakes of the chair. Next, the operator can pivot the front chair 10*a* forward and attach the bottom rack 100 of the front chair to its associated seat assembly 12 at a position somewhere between fully reclined and fully inclined (forward tilted). Once the bottom rack 100 has been attached to the seat assembly 12, the operator can complete the forward tilting of the front chair 10*a*. Next, the operator can fold up the footrests 116 of the rear chair 10*b* and then push the rear chair forward between the rear wheels 86 of the front chair 10*a* until the footrests of the rear chair contact the deployed stop member 104 of the front chair. At that point, the operator can set the brakes of the rear chair 10*b* and, if desired, attach the bottom rack 100 to the seat assembly 12 and fully forward tilt the seat assembly so that a further chair can be nested behind the rear chair.

The operator can perform the reverse operation to unnest the rear chair 10*b* from the front chair 10*a*. For example, the operator can pivot the seat assembly 12 of the rear chair 0*b* back and detach the bottom rack 100 so it can be placed in its horizontal orientation (supported by the rear flanges 84 of the side tubes 82). Once the seat 12 assembly has been reclined, the operator can release the brakes of the rear chair 10*b* and withdraw the rear chair from the front chair 10*a*. Before the rear chair 10*b* can be used by a patient, the operator must unfold the footrests 16. If deemed necessary, the seat assembly 12 can again be titled forward after the footrests 116 have been unfolded to facilitate easier entry into the chair 10 by the patient. Because the forward tilting of the chair causes the footrests 116 to engage the floor or ground, the operator must recline the chair 10 before it can be used to transport the patient. Notably, such reclining would still be necessary even if the footrests 116 did not engage the floor or ground because the forward tilt angles of the seat 30 and backrest 32 are such that the patient could slip and fall forward out of the chair 10 if transport were attempted before reclining the seat assembly 12.

Figure 14:
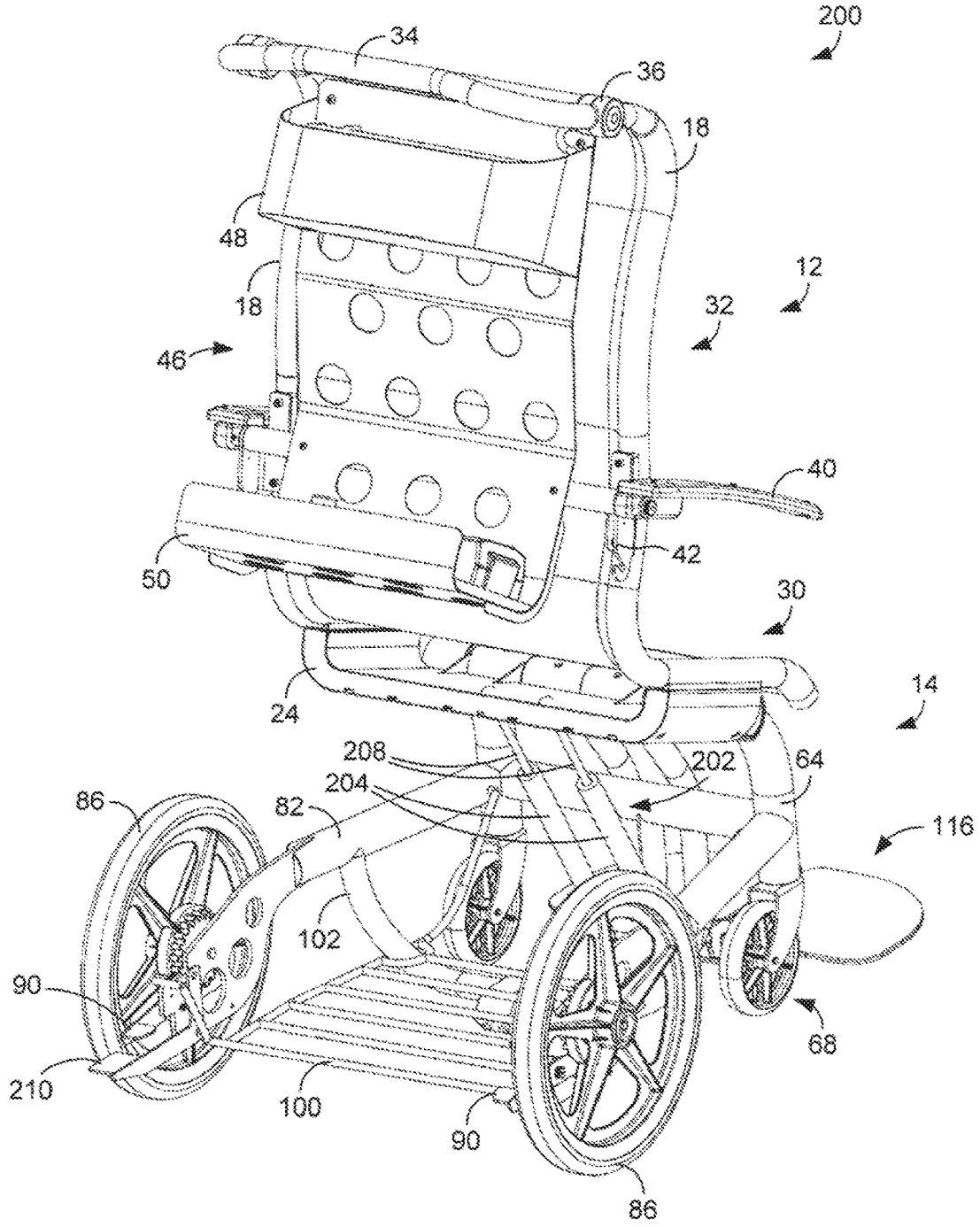
FIG. 14 is a rear perspective view of another example embodiment of a transport chair.
Figure 15A:
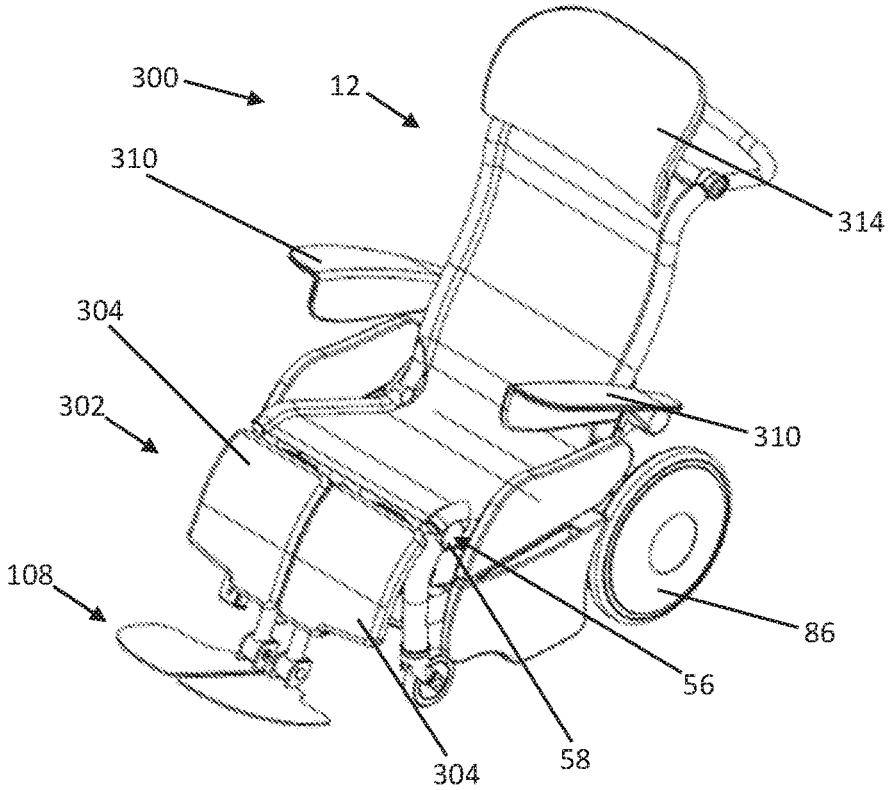
FIG. 15A is a perspective view of an alternative version of the transport chair in an upright configuration.
Figure 15B:
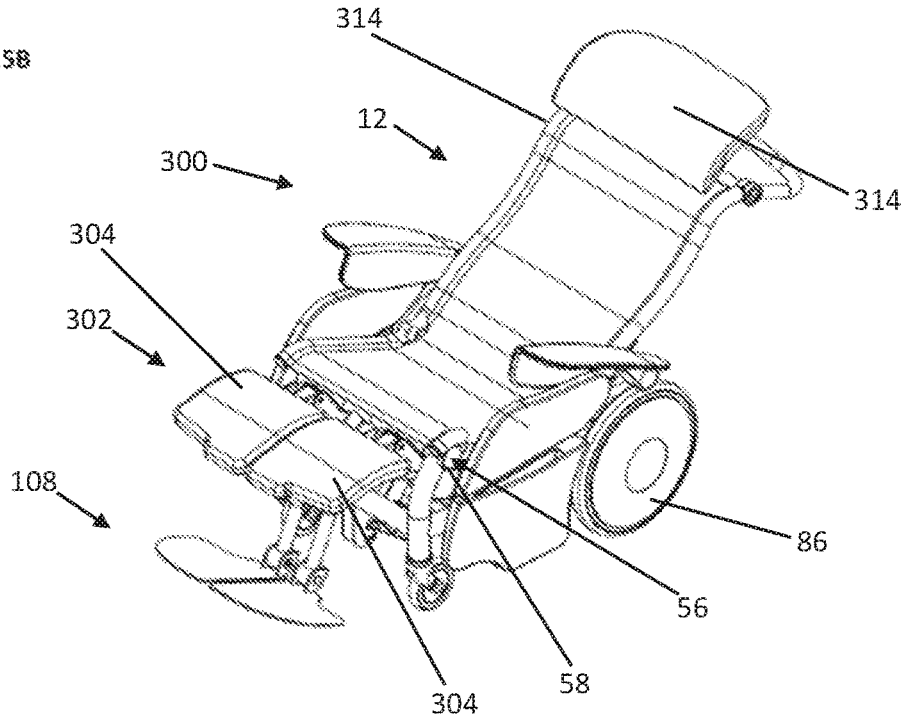
FIG. 15B is a perspective view of the alternative version of the transport chair shown in FIG. 15A, in a reclined configuration. Note the elevation of the leg rest and the alteration in the angulation and position of the armrests.
Figure 16A:
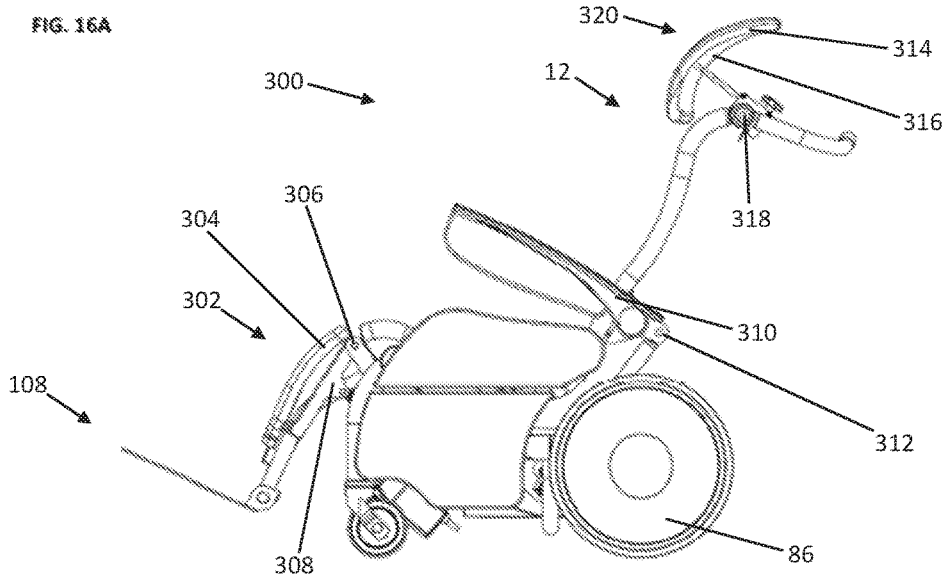
FIG. 16A is a side view of the alternative version of the transport chair shown in FIG. 15A in the upright configuration.
Figure 16B:
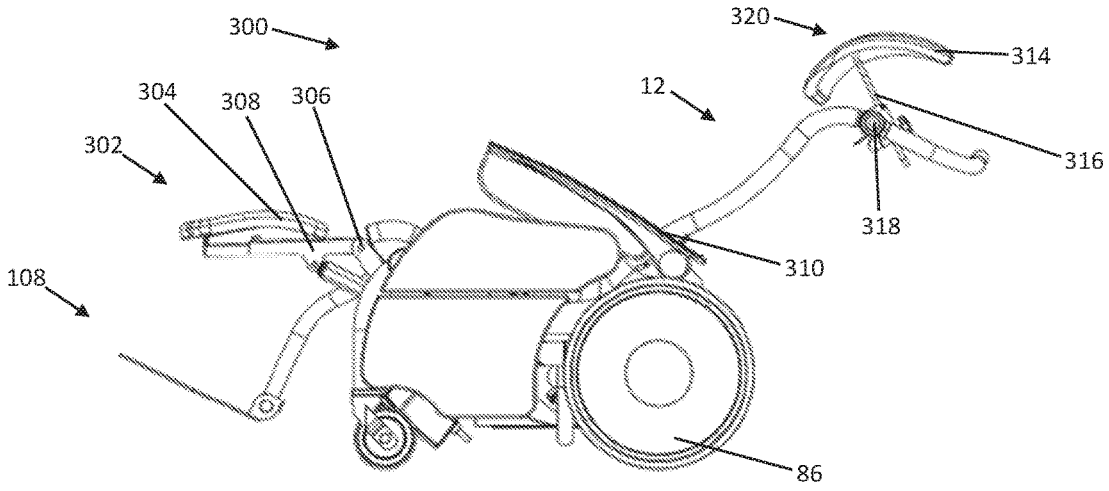
FIG. 16B is a side view of the alternative version of the transport chair shown in FIG. 15B in the reclined position.
Figure 17A:
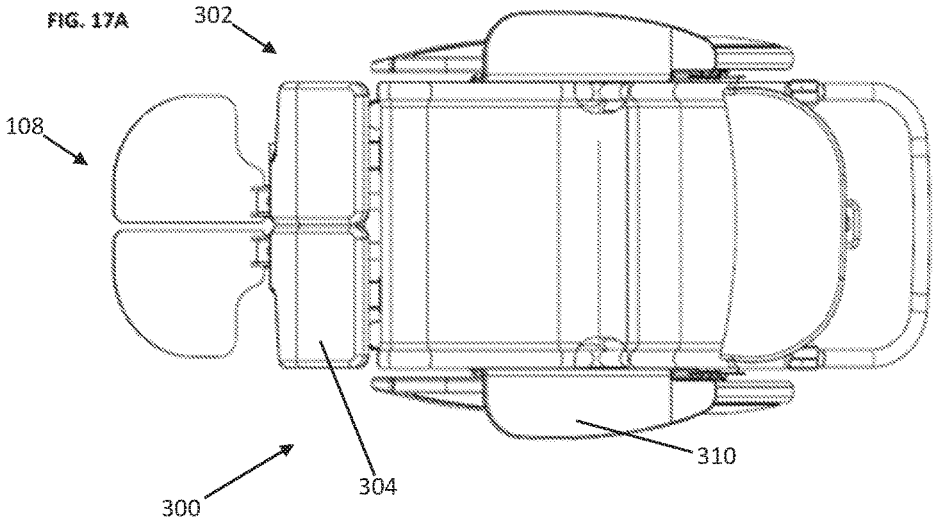
FIG. 17A is a top view of the alternative version of the transport chair shown in FIG. 15A in the upright configuration.
Figure 17B:
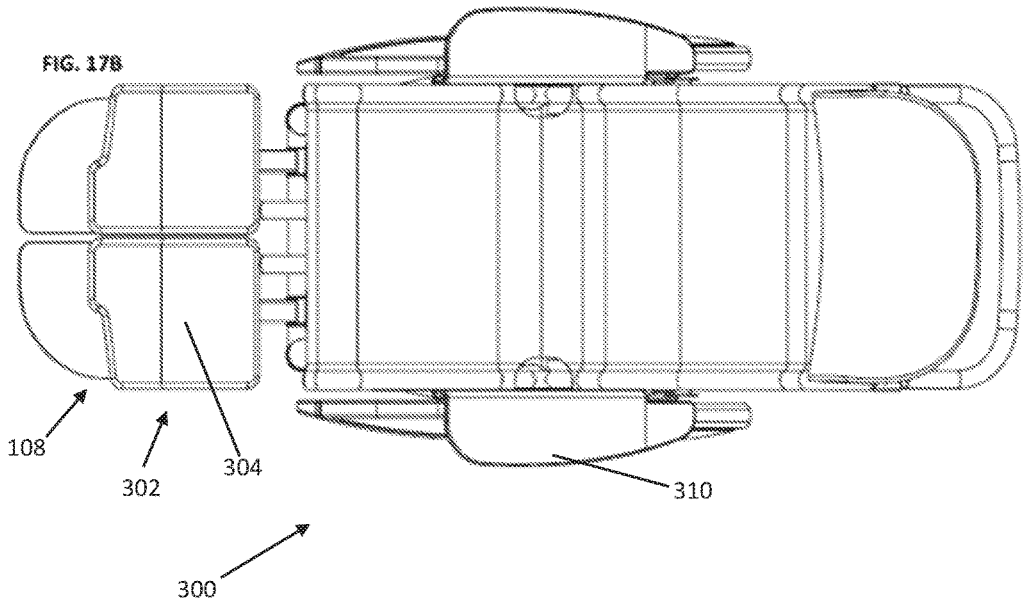
FIG. 17B is a top view of the alternative version of the transport chair shown in FIG. 15B in the reclined position.
Figure 18A:
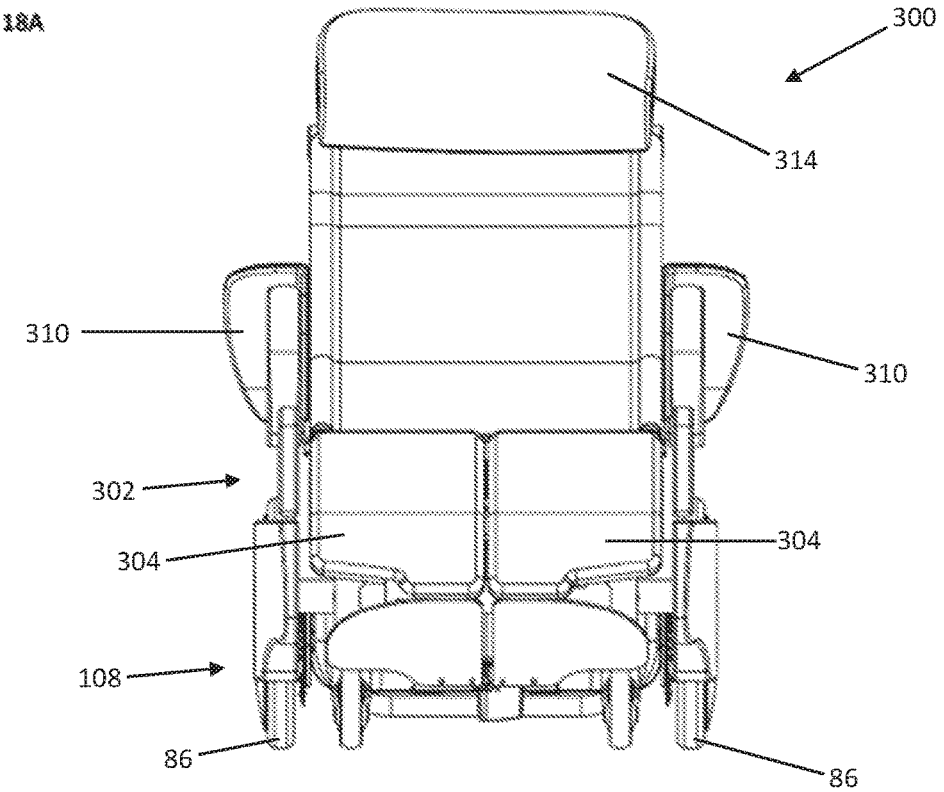
FIG. 18A is a front view of the alternative version of the transport chair shown in FIG. 15A in the upright configuration.
Figure 18B:
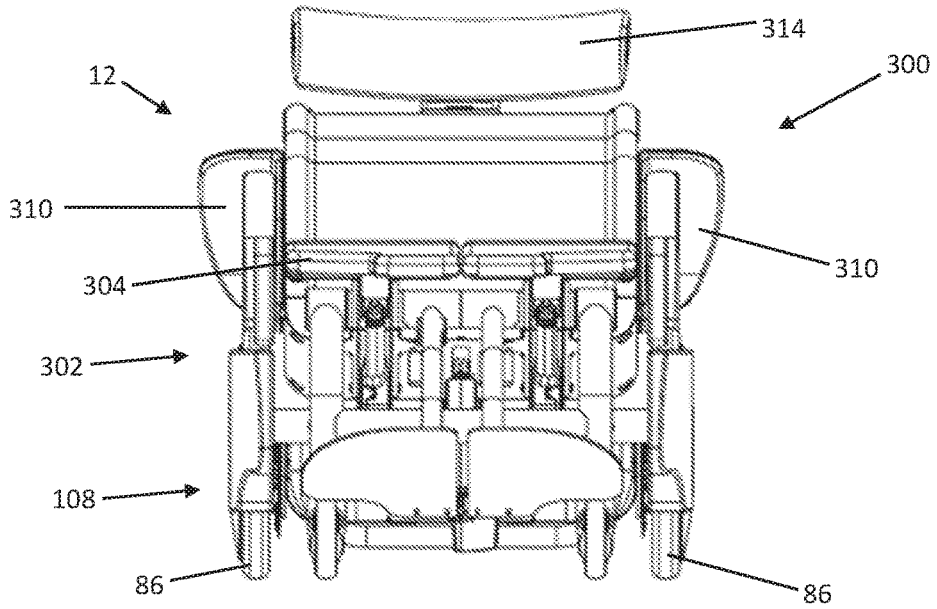
FIG. 18B is a front view of the alternative version of the transport chair shown in FIG. 15B in the reclined position.

FIG. 14 illustrates another example transport chair 200. The chair 200 is similar in many ways with the transport chair 10. However, the lifting mechanism 202 of the chair 200 is configured as a gas piston lifting mechanism. In the embodiment of FIG. 14, the lifting mechanism 202 comprises two gas pistons 204, each having a housing that contains a pressurized gas that is used to drive a shaft 208 from the housing. The lifting mechanism 202 operates in similar manner to a lifting mechanism of an office chair. Specifically, the pistons 204 maintain a given seat orientation until they are activated, in this case by a foot pedal 210. At that point, gas can flow within the pistons 204 to apply an extending force to the shafts 208. In some embodiments, the force provided by the pistons 204 is not, by itself, enough to pivot the seat assembly 12 forward when a patient is seated in the chair 10. Instead, the pistons 204 provide lifting assistance to the operator when the operator manually pivots the seat assembly 12 forward using the handle 34. That said, the force provided by the pistons 204 greatly reduces the amount of effort required from the operator to pivot the seat assembly 12 forward. When the foot pedal 210 is released, the pistons 204 will hold whatever orientation the seat assembly 12 is in.

An alternative general embodiment of the wheelchair 300, shown in FIGS. 15-18, is capable of reclining, in addition to having forward-leaning capability (referred to from this point forward as "inclining forward" or simply "inclining"). In some embodiments of the reclining chair 300, the seat assembly 12 both reclines and inclines forward about the same pivot axis 56, which may be the pivot shaft 58 discussed above. Multiple additional features may be present to facilitate a comfortable and ergonomically advantageous reclining position for the patient.

For example, one or more features may be present to raise the patient's legs while the patient reclines. One such feature is a leg rest assembly 302 that is separate from the footrest assembly 108. Although the footrest could be designed to elevate when the patient reclines, such an approach has a number of problems. The footrest would be angled too high for the patient's feet to rest stably, and they would have a tendency to slip off (absent some complex mechanism for reorienting the footrest). The footrest would protrude in front of the patient, potentially striking objects in front of the chair while in forward motion or turning. In a reclining position the feet are not well positioned to support the rest of a patient's leg. An independently articulating leg rest has none of these problems.

Consequently, embodiments of the wheelchair 300 may comprise a leg rest assembly 302 configured to pivot to elevate independent of the footrest assembly 108, and configured to pivot to ascend in unison with the seat assembly 12 as said seat assembly 12 pivots to recline. When the wheelchair 300 is in its upright position, the leg rest assembly 302 is retracted, in a non-elevated position (see FIGS. 15A and 16A). The leg rest assembly 302 may elevate via any of a number of types of actuators, as known in the art. The leg rest assembly 302 may be configured to cease elevating once the patient's legs have been raised to an approximately horizontal position. Some embodiments of the leg rest assembly 302 may have the capability to elevate independent of the seat assembly 12, to allow a patient sitting upright to rest one or more legs. Although the embodiment of the leg rest assembly 302 shown in FIGS. 15-18 is shown as having two leg rest pads 304 (left and right), it is contemplated that the leg rest assembly 302 could have a single pad 304 on which both legs rest. In embodiments of the leg rest 302 that have two pads 304 as shown, the leg rest assembly 302 could be configured to allow each leg to elevate independent of the other. This could be useful under various circumstances, such as when a patient has a single leg in a cast or a brace that will not permit the patient to bend her knee.

When the leg rest assembly 302 elevates in unison with the seat assembly 12 as it reclines, the degree of elevation of the leg rest assembly 302 may be a function of the degree of reclination of the seat assembly 12. Such configurations have the advantage of allowing the patient's back to recline without leaving the legs in a potentially uncomfortable seated position. The leg rest assembly 302 may also have the ability to elevate independent of the reclination of the seat assembly 12, for example to support an injured leg while the patient sits upright.

In the embodiment illustrated in the drawings, the leg rest assembly 302 pivots about an axis 306 at the front edge of the seat, just in front of the seat assembly's pivot shaft 58. The axis 306 in the illustrated embodiment is proximate to the axis 56 about which the footrest assembly 108 and seat assembly 12 pivot. In further embodiments, the leg rest assembly 302, the footrest assembly 108, and the seat assembly 12 pivot about a common axis (not shown). The leg rest pivot axis 306, as shown, intersects a left and a right leg pad support member 308, which is jointed. In other possible embodiments, the leg rest assembly 302 could potentially share the pivot shaft 58 with the seat assembly 12.

Another possible feature of the reclining chair 300 is a pair of articulating armrests 310. When the patient reclines, the patient's shoulders translate downward, causing the arms to be reoriented. This can cause the arms to be pulled into a position in which the elbows are not in contact with a static armrest. Not only can this be uncomfortable, but if the patient has in IV line in, this position could potentially put unwanted tension on the IV line or cause the hypodermic needle to damage the surrounding tissue. In the illustrated embodiment of the wheelchair 300, the armrest 310 pivots about a pivot axis 312 located near the back of the armrest 310 and translates toward the rear wheels 86 when the seat assembly 12 reclines. Thus the patient's arms remain supported by the armrests 310. Superior ergonomic positioning can be achieved by pivoting the armrests 310 such that they remain parallel to the footrest assembly 108 as the armrests 310 pivot and translate. In a further embodiment of the wheelchair 300, the armrests 310 translate toward the rear wheels 86 until contact is made between the armrest 310 and the rear wheels 86 (shown in FIGS. 15B and 16B). Such contact can have the effect of restricting or arresting the rolling of the wheels 86. It can serve to lock the movement of the wheelchair 300 when the patient is in a reclined position.

Another possible feature of the reclining chair 300 shown in FIGS. 15-18 is a headrest 314. Conventional wheelchairs provide no support to the head. The absence of a headrest precludes the use of conventional wheelchairs for patients with neck injuries or weak neck muscles, requiring the use of a gurney or like means of transportation. In addition, even for patients able to maintain the head in an upright position, protracted periods in a wheelchair can be tiring, but the patient cannot sleep in a conventional wheelchair without the patient's head falling to one side, which often awakens the patient (thus making sleep impossible). The headrest 314 may be configured to be adjustable to meet the needs of patients with differing body sizes. As shown in the illustrated embodiments, the position may be adjustable using a headrest support arm 316 that rotates about an axis 318 behind the patient's head and translates toward or away from the axis 318. The headrest 314 may also have a generally arcuate profile 320 as shown in FIGS. 16A and 16B; this maintains the head in the same orientation in a reclined position as in an upright position.

In the foregoing disclosure, various embodiments have been discussed. It is noted those embodiments are mere examples and that many other variations are possible. In one such variation, a motor can be added to the chairs to drive the rear wheels. In such an embodiment, the patient could drive himself or herself. In another example, the lifting mechanism can comprise a compressor that pneumatically raises and lowers the seat assembly. In a further example, the chair can be a stationary chair that does not include wheels. In such a case, the chair can be used in other situations in which sitting or standing assistance is needed. For example, the chair could be used in a doctor's or dentist's office. Many other modifications are possible, and all such modifications are intended to fall within the scope of this disclosure.

The following is claimed:

1. A wheelchair configured to recline and incline forward, said wheelchair comprising:

(a) a base frame having a first pivot axis;

(b) at least two wheels rotationally mounted to said base frame;

(c) a seat assembly and a footrest assembly configured to pivot about said first pivot axis from a first seated position to an inclined seated position; and (d) a leg rest assembly pivotally coupled to said base frame and configured to pivot about a second pivot axis to elevate in unison with the seat assembly when said seat assembly reclines but independent of said footrest assembly.

2. The wheelchair of claim 1, wherein the second pivot axis is proximate to or congruent with the first pivot axis.

3. The wheelchair of claim 1, comprising:

a pivot shaft defining said first pivot axis, wherein the seat assembly is fixedly mounted to the pivot shaft such that the seat assembly pivots about the pivot shaft to incline forward, and such that the seat assembly pivots about the pivot shaft to recline;

wherein a base frame member extends from the pivot shaft to the at least two wheels, such that the pivot shaft is free to pivot independent of the base frame member; and wherein footrest assembly is pivotally mounted to the pivot shaft such that the footrest assembly is free to pivot independent of the pivot shaft, the footrest assembly being associated with the seat assembly so as to pivot in unison with the seat assembly when the seat assembly pivots forward until the footrest assembly is pivoted forward to an extent at which point the footrest assembly contacts the floor or ground, at which point the footrest assembly without manual intervention does not pivot forward further upon further forward pivoting of the seat assembly.

4. The wheelchair of claim 1, comprising:

a front wheel, and wherein the two wheels rotationally mounted to said base frame are rear wheels mounted to a rear portion of the base frame;

a pivot shaft on the base frame positioned near a front edge of the seat that defines the first pivot axis about which the seat assembly can pivot to incline forward or recline, the seat assembly being fixedly mounted to the pivot shaft;

wherein the seat assembly defines a seat and a backrest;

the base frame supports the seat assembly; and the footrest assembly is mounted to the pivot shaft, the footrest assembly being free to pivot to incline forward independent of the pivot shaft and being physically coupled with the seat assembly so as to pivot to incline forward in unison with the seat assembly until the seat assembly is inclined forward to an extent at which the footrest assembly contacts the floor or ground, at which point the footrest assembly without manual intervention does not pivot to incline forward further upon further forward inclination of the seat assembly.

5. The wheelchair of claim 1, comprising:

(a) a pivot shaft defining the first pivot axis, and pivotally mounted to the base frame so as to be able to pivot relative to the base frame, wherein the seat assembly is fixedly mounted to the pivot shaft such that the seat assembly pivots about the pivot shaft to incline forward and to recline;

(b) a frame member extending from the pivot shaft to at least one wheel, such that the pivot shaft is free to pivot independent of the frame member;

(c) means provided on the seat assembly and the footrest assembly for causing the footrest assembly to pivot to incline forward in unison with the seat assembly when the footrest assembly is not in contact with the floor or ground but enabling the footrest assembly to remain stationary as the seat assembly inclines forward if the footrest assembly is in contact with the floor or ground; and wherein the footrest assembly is pivotally mounted to the pivot shaft such that the footrest assembly is free to pivot to incline forward independent of the pivot shaft and in unison with the seat assembly during use of the chair, but does not pivot to recline in unison with the seat assembly when the seat assembly reclines.

6. The wheelchair of claim 1, wherein the seat assembly comprises a seat having a front edge and a rear edge, said seat assembly configured to incline forward and recline;

the footrest assembly comprises a support member having an upper end and a lower end, and a foot plate extending from said support member near the lower end thereof;

the seat assembly and the footrest assembly are pivotally coupled to one another near said front edge and said upper end; and said seat assembly and footrest configured to pivot in unison while pivoting about the first pivot axis to incline forward from a first seated position in which said footplate is elevated above a floor to a second seated position at which said foot plate contacts the floor, whereupon the seat assembly is configured to decouple from said footrest assembly and continue inclining forward.

7. The wheelchair of claim 1, comprising a pivot shaft defining the first pivot axis.

8. The wheelchair of claim 1, wherein the second pivot axis is forward of the first pivot axis.

9. The wheelchair of claim 1, wherein the second pivot axis is at a forward end of the seat assembly.

10. The wheelchair of claim 1, wherein the leg rest assembly comprises a right leg pad and a left leg pad.

11. The wheelchair of claim 1, wherein the leg rest assembly comprises a right leg pad supported by a right leg pad aim, and a left leg pad supported by a left leg pad arm, and wherein the left and right leg pad arms each extend to the second pivot axis and pivot about said second pivot axis.

12. The wheelchair of claim 1, wherein the leg rest assembly is configured to elevate independent of the seat assembly when said seat assembly is in the first seated position.

13. The wheelchair of claim 1, wherein the leg rest assembly is configured to elevate and lower independent of the seat assembly, in addition to elevate in unison with the seat assembly when said seat assembly reclines.

14. The wheelchair of claim 1, comprising a pair of armrests configured to allow the armrests to translate relative to the base frame and to pivot relative to the base frame about a third pivot axis.

15. The wheelchair of claim 1, comprising a pair of armrests configured to allow the armrests to translate relative to the base frame and to pivot relative to the base frame about a third pivot axis, wherein said armrests are configured to translate toward the rear and bottom of the wheelchair in unison with the seat assembly as the seat assembly pivots to recline.

16. The wheelchair of claim 1, comprising a pair of armrests configured to allow the armrests to translate relative to the base frame and to pivot relative to the base frame about a third pivot axis, wherein said armrests are configured to pivot to maintain an inclination that is parallel to an inclination of the footrest as the seat assembly pivots to recline.

17. The wheelchair of claim 1, comprising a pair of armrests configured to allow the armrests to translate relative to the base frame, wherein said armrests are configured to translate to come into contact with the wheels of the wheelchair in unison with the seat assembly as the seat assembly pivots to recline, such contact restricting rotation of said wheels.

18. The wheelchair of claim 1, comprising a headrest mounted to the seat assembly and adjustable with at least two degrees of freedom.

19. The wheelchair of claim 1, comprising a headrest mounted to the seat assembly via a headrest post, the headrest post connected to the seat assembly via a pivot connection with a headrest pivot axis approximately parallel to a coronal plane.

20. The wheelchair of claim 1, comprising a headrest mounted to the seat assembly via a headrest post, the headrest post connected to the seat assembly via a sliding connection that allows the distance from the seat assembly to the headrest to be adjusted.

* * * * *